US010214022B2

(12) United States Patent
Atsumi

(10) Patent No.: US 10,214,022 B2
(45) Date of Patent: Feb. 26, 2019

(54) DIAPHRAGM PUMP, INK SUPPLY SYSTEM, AND INKJET PRINTER

(71) Applicant: Roland DG Corporation, Hamamatsu-shi, Shizuoka (JP)

(72) Inventor: Hidetoshi Atsumi, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/828,520

(22) Filed: Dec. 1, 2017

(65) Prior Publication Data

US 2018/0154648 A1 Jun. 7, 2018

(30) Foreign Application Priority Data

Dec. 6, 2016 (JP) ..... 2016-236885

(51) Int. Cl.

| | |
|---|---|
| ***B41J 2/175*** | (2006.01) |
| ***F04B 43/02*** | (2006.01) |
| ***F04B 49/06*** | (2006.01) |
| ***F04B 53/10*** | (2006.01) |

(52) U.S. Cl.

CPC ..... *B41J 2/17596* (2013.01); *B41J 2/175* (2013.01); *B41J 2/17566* (2013.01); *F04B 43/02* (2013.01); *F04B 43/028* (2013.01); *F04B 49/065* (2013.01); *F04B 53/1072* (2013.01)

(58) Field of Classification Search

CPC .... B41J 2/175; B41J 2/17566; B41J 2/17596; F04B 43/02; F04B 43/028; F04B 53/10; F04B 53/1062; F16F 15/144; F16K 15/16

USPC ..... 347/84, 85, 94

See application file for complete search history.

(56) References Cited

U.S. PATENT DOCUMENTS

| | | | | |
|---|---|---|---|---|
| 5,888,056 A * | 3/1999 | Kim | F04B 11/0025 417/312 |
| 6,004,105 A * | 12/1999 | Reynolds | F04B 43/0736 417/386 |
| 7,284,572 B2 * | 10/2007 | Kach | F04B 53/1062 137/859 |
| 2005/0155657 A1 | 7/2005 | Kach et al. | |

FOREIGN PATENT DOCUMENTS

JP 4921714 B2 4/2012

OTHER PUBLICATIONS

Ueda, "Damper Device, Ink Supply System, and Inkjet Printer," U.S. Appl. No. 15/828,518, filed Dec. 1, 2017.

* cited by examiner

*Primary Examiner* — An H Do
(74) *Attorney, Agent, or Firm* — Keating & Bennett, LLP

(57) ABSTRACT

A diaphragm pump includes an inflow chamber and an outflow chamber. The inflow chamber is provided with an inflow valve seat. An inflow valve that prevents backflow of a liquid is disposed against the inflow valve seat. The outflow chamber is provided with an outflow valve seat. An outflow valve that prevents backflow of a liquid is disposed against the outflow valve seat. The diaphragm pump also includes an inflow-valve presser that presses the inflow valve against the inflow valve seat, and an outflow-valve presser that presses the outflow valve against the outflow valve seat. Each of the inflow valve and the outflow valve is defined by an elastically deformable member. Each of the inflow valve seat and the outflow valve seat includes a surface at least a portion of which is a curved surface.

15 Claims, 9 Drawing Sheets

DIAPHRAGM PUMP, INK SUPPLY SYSTEM, AND INKJET PRINTER

CROSS REFERENCE TO RELATED APPLICATIONS

This application claims the benefit of priority to Japanese Patent Application No. 2016-236885 filed on Dec. 6, 2016. The entire contents of this application are hereby incorporated herein by reference.

BACKGROUND OF THE INVENTION

1. Field of the Invention

The present invention relates to a diaphragm pump, an ink supply system including the diaphragm pump, and an inkjet printer including the ink supply system.

2. Description of the Related Art

An inkjet printer including an ink head including nozzles ejecting ink is well known. This type of inkjet printer prints on a recording medium by ejecting ink from the nozzles of the ink head onto the recording medium.

In this type of inkjet printer, as the nozzles of the ink head eject the ink, the amount of ink stored in the ink head decreases. The ink head is connected to an ink tank that stores the ink. The ink in the ink tank is supplied to the ink head. When supplying the ink to the ink head, a pump is used. As an example of the pump that supplies ink to the ink head, Japanese Patent No. 4921714, for example, discloses a diaphragm pump.

The diaphragm pump disclosed in Japanese Patent No. 4921714 includes a valve that functions as a backflow prevention valve for preventing backflow of ink, which sits on a valve seat. The valve seat includes an opening to an inflow passage into which ink flows, and the valve includes a plate-shaped closing object that closes the opening to the inflow passage. In order to prevent backflow of ink into the inflow passage, it is desirable that the closing object of the valve makes intimate contact with the valve seat more reliably when ink is likely to cause backflow.

SUMMARY OF THE INVENTION

In view of the foregoing and other problems, preferred embodiments of the present invention provide diaphragm pumps, ink supply systems, and inkjet printers that make it possible to prevent backflow of liquid, such as ink.

A diaphragm pump according to a preferred embodiment of the present invention includes an inflow port, an inflow chamber, a first inlet flow passage, a pumping chamber, a second inlet flow passage, an outflow chamber, a first outlet flow passage, an outflow port, a second outlet flow passage, an inflow valve, an outflow valve, an inflow-valve presser, and an outflow-valve presser. The inflow port allows a liquid to flow thereinto from outside the diaphragm pump. The inflow chamber is provided with an inflow valve seat. The first inlet flow passage allows the inflow port and the inflow chamber to communicate with each other. In the pumping chamber, an elastically deformable diaphragm is disposed. The second inlet flow passage allows the inflow chamber and the pumping chamber to communicate with each other. The outflow chamber is provided with an outflow valve seat. The first outlet flow passage allows the pumping chamber and the outflow chamber to communicate with each other.

The outflow port allows the liquid to flow out therefrom to outside the diaphragm pump. The second outlet flow passage allows the outflow chamber and the outflow port to communicate with each other. The inflow valve is disposed against the inflow valve seat and causes the first inlet flow passage to open and close. The outflow valve is disposed against the outflow valve seat and causes the first outlet flow passage to open and close. The inflow-valve presser presses the inflow valve against the inflow valve seat. The outflow-valve presser presses the outflow valve against the outflow valve seat. Each of the inflow valve and the outflow valve is defined by an elastically deformable member. Each of the inflow valve seat and the outflow valve seat includes a surface at least a portion of which is a curved surface.

In the above diaphragm pump, the elastically deformable inflow valve is elastically deformed along the curved surface of the inflow valve seat, and is placed onto the inflow valve seat. As a result, a gap is unlikely to form between the inflow valve and the inflow valve seat. This prevents backflow of the liquid in the first inlet flow passage more effectively. In addition, the elastically deformable outflow valve is elastically deformed along the curved surface of the outflow valve seat, and is placed onto the outflow valve seat. As a result, a gap is unlikely to form between the outflow valve and the outflow valve seat. This prevents backflow of the liquid in the first outlet flow passage more effectively.

Preferred embodiments of the present invention provide diaphragm pumps that reduce backflow of a liquid.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinbelow, with reference to the drawings, ink supply systems including diaphragm pumps and inkjet printers including the ink supply systems will be described according to preferred embodiments of the present invention. The preferred embodiments described herein are, of course, not intended to limit the present invention. The features and components that exhibit the same effects are denoted by the same reference symbols, and repetitive description thereof may be omitted as appropriate.

Figure 1:
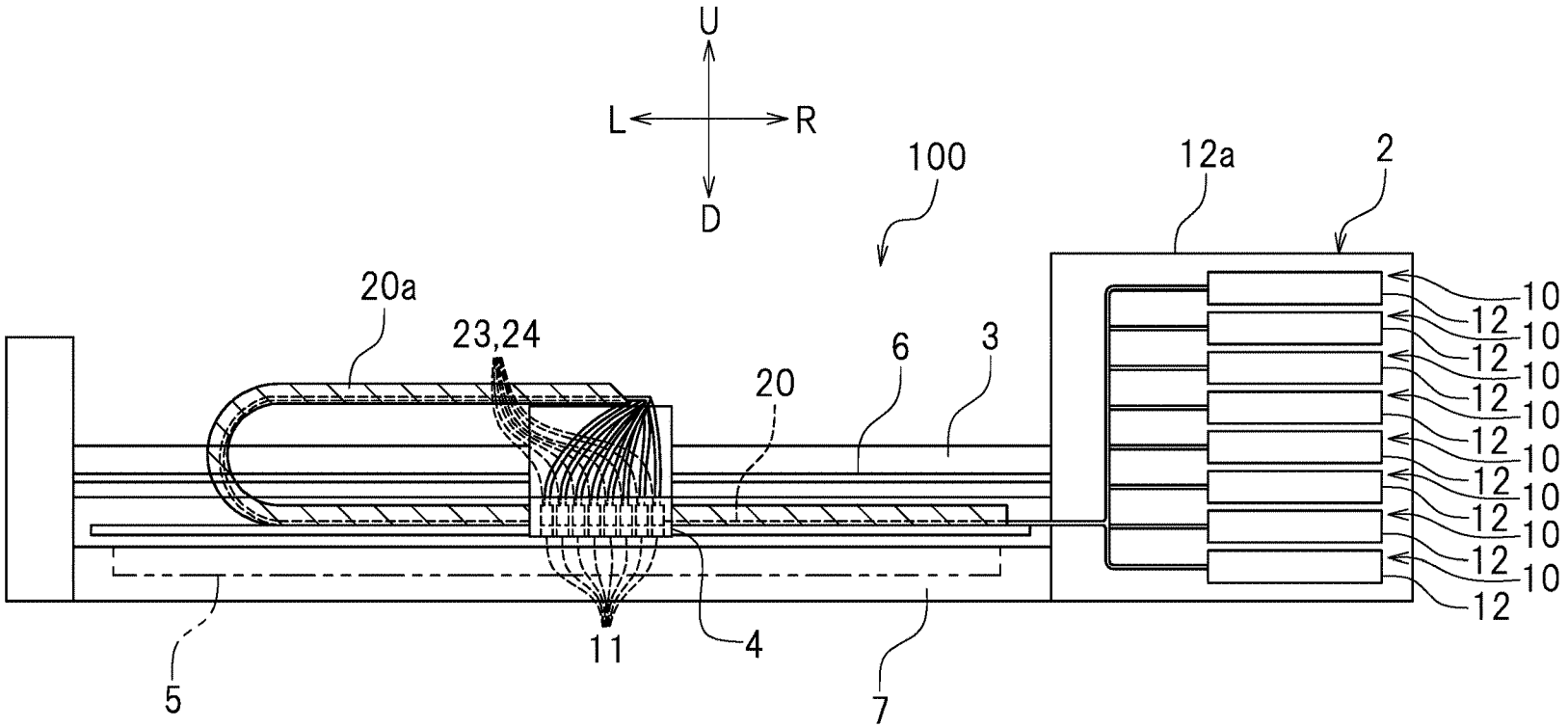
FIG. 1 is a front view illustrating a printer according to a preferred embodiment of the present invention.

FIG. 1 is a front view illustrating an inkjet printer (hereinafter simply "printer") 100 according to a preferred embodiment of the present invention. The printer 100 is an inkjet printer. The term "inkjet" in the preferred embodiments herein is intended to include various types of inkjet printing, including various continuous printing such as binary deflection printing and a continuous deflection printing, and various on-demand printing such as thermal printing and piezoelectric printing. In the following description, reference characters F, Rr, L, R, U, and D in the drawings respectively represent front, rear, left, right, up, and down when the printer 100 is viewed from the front. The just-mentioned directional terms are, however, merely provided for convenience in description, and are not intended to limit in any way the manner in which the printer 100 should be arranged.

As illustrated in FIG. 1, the printer 100 prints on a recording medium 5. In the present preferred embodiment, the recording medium 5 may be recording paper in a roll form, i.e., what is called roll paper. The recording medium 5 is, however, not limited to recording paper in a roll form. For example, the recording medium 5 may be a resin sheet. Moreover, the recording medium 5 is not limited to a flexible sheet. For example, the recording medium 5 may be a medium made of a hard material, such as glass substrate. In the present preferred embodiment, the material that forms the recording medium 5 is not limited to a particular material.

In the present preferred embodiment, the printer 100 includes a printer main body 2 and a guide rail 3 secured to the printer main body 2. The guide rail 3 extends, for example, along a leftward/rightward direction. Herein, a carriage 4 is engaged with the guide rail 3. The carriage 4 is slidable along the guide rail 3. Although not shown in the drawings, rollers are provided respectively at the left and right ends of the guide rail 3. One of the rollers is connected to a carriage motor (not shown). The one of the rollers that is connected to the carriage motor is rotated by the carriage motor. An endless belt 6 is wound around the rollers provided at the respective ends of the guide rail 3. The carriage 4 is secured to the belt 6. By actuating the carriage motor, the rollers are rotated to thereby run the belt 6. As the belt 6 runs, the carriage 4 moves in a leftward or rightward direction. Thus, the carriage 4 is movable in leftward and rightward directions along the guide rail 3.

In the present preferred embodiment, the printer main body 2 is provided with a platen 7 on which the recording medium 5 is to be placed. The platen 7 supports the recording medium 5 when a printing operation is performed on the recording medium 5. The platen 7 is provided with a grit roller (not shown) and pinch rollers (not shown), which are arranged vertically and paired with each other. The grit roller is coupled to a feed motor (not shown). The grit roller is caused to rotate by the feed motor. By rotating the grit roller with the recording medium 5 pinched between the grit roller and the pinch rollers, the recording medium 5 is delivered in a frontward or rearward direction.

In the present preferred embodiment, the printer 100 includes a plurality of ink supply systems 10. Each of the ink supply systems 10 supplies ink from an ink tank 12 to an ink head 11. Each of the ink supply systems 10 also serves to circulate the ink supplied to the ink head 11. The ink supply system 10 is provided for each one of the ink heads 11. In other words, the ink supply system 10 is provided for each one of the ink tanks 12. In the present preferred embodiment, the number of the ink heads 11 is "8", so the number of the ink supply systems 10 is accordingly "8", for example. However, the number of the ink heads 11, the number of the ink tanks 12, and the number of the ink supply systems 10 are not limited to particular numbers. Note that the plurality of ink supply systems 10 preferably have the same structure. On that basis, the following description details the configuration of one ink supply system 10.

Figure 2:
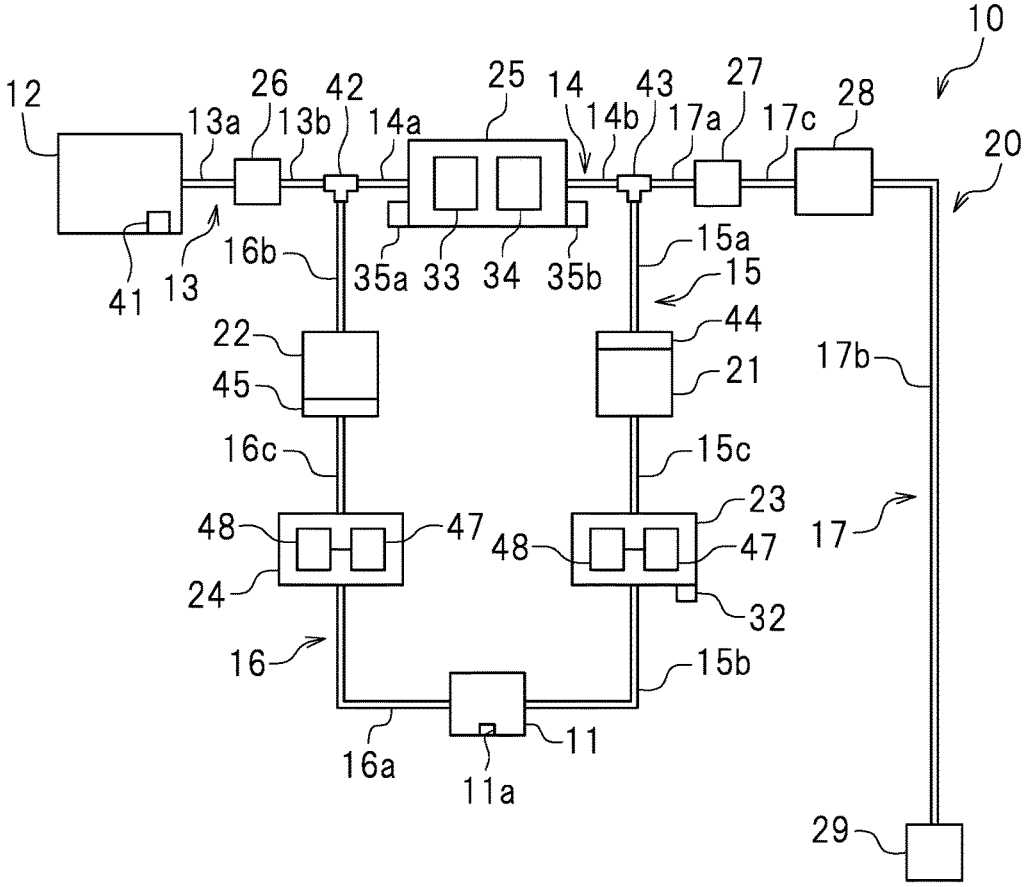
FIG. 2 is a schematic view illustrating an ink supply system.

FIG. 2 is a schematic view illustrating the ink supply system 10. As illustrated in FIG. 2, the ink supply system 10 includes an ink head 11, an ink tank 12, an ink flow channel 20, an upstream pump 21, a downstream pump 22, an upstream damper 23, a downstream damper 24, an air trap 25, an inlet valve 26, an outlet valve 27, and an outlet pump 28. In the following description, the term "upstream" refers to where the ink flows into the ink head 11 from. The term "downstream" refers to where the ink flows from the ink head 11 into.

As illustrated in FIG. 1, the ink head 11 ejects ink onto the recording medium 5 that is placed on the platen 7. As illustrated in FIG. 2, a nozzle 11*a* is provided in the bottom surface of the ink head 11. As illustrated in FIG. 1, the ink head 11 is mounted on the carriage 4. The ink head 11 is movable in a leftward or rightward direction along the guide rail 3 via the carriage 4. More specifically, by actuating the carriage motor for running the belt 6, the ink head 11 are moved in a leftward or rightward direction along with the carriage 4.

The ink tank 12 stores ink. In the present preferred embodiment, the number of ink tanks 12 is equal to the number of ink heads 11. Herein, the number of ink tanks 12 is set to "8", for example. One ink head 11 is connected correspondingly to each one of the ink tanks 12. The inks stored in the ink tanks 12 are supplied to the ink heads 11. The ink stored in one of the ink tanks 12 may be, for example, any one of process color inks, such as cyan ink, magenta ink, yellow ink, light cyan ink, light magenta ink, and black ink, and spot color inks, such as white ink, metallic ink, and clear ink. In the present preferred embodiment, an ink of the same color is stored in two ink tanks 12 among the eight ink tanks 12. For example, the eight ink supply systems 10 may be grouped into four groups, the first group, the second group, the third group, and the fourth group. Each of the groups includes two ink supply systems 10. In this case, for example, the ink tanks 12 in the first group of the ink supply systems 10 store cyan ink. The ink tanks 12 in the second group of the ink supply systems 10 store magenta ink. The ink tanks 12 in the third group of the ink supply systems 10 store yellow ink. The ink tanks 12 in the fourth group of the ink supply systems 10 store black ink. However, it is also possible that the plurality of ink tanks 12 may store different inks from each other. Although not shown in the drawings, each of the ink tanks 12 is provided with an ink outlet port (not shown).

Note that the positions of the ink tanks 12 are not limited to particular positions. In the present preferred embodiment, the ink tanks 12 are attachable to and detachable from the printer main body 2. More specifically, for example, the printer main body 2 includes an accommodation section 12*a*, as illustrated in FIG. 1. The plurality of ink tanks 12 are accommodated in the accommodation section 12*a*. However, the positions of the ink tanks 12 are not limited to particular positions. For example, the ink tanks 12 may be provided so as to be attachable to and detachable from the carriage 4.

As illustrated in FIG. 2, the ink tank 12 may be provided with a detection sensor 41 that detects the amount of the ink stored in the ink tank 12. The detection sensor 41 is not limited to a particular type of detection sensor. For example, the detection sensor 41 may be a photo interrupter. For example, the detection sensor 41 detects that the amount of ink stored in the ink tank 12 is a predetermined amount that has been determined in advance.

The ink flow channel 20 is a flow channel that supplies the ink stored in the ink tank 12 to the ink head 11 and also allows the ink within the ink head 11 to circulate therethrough. As illustrated in FIG. 1, in the present preferred embodiment, at least a portion of the ink flow channel 20 is covered with a cable protection and guide device 20*a*. The cable protection and guide device 20*a* may be, for example, a Cableveyor (registered trademark). As illustrated in FIG. 2, the ink flow channel 20 includes an inlet flow channel 13, a connection flow channel 14, an upstream flow channel 15, a downstream flow channel 16, and an outlet flow channel 17.

The inlet flow channel 13 is a flow channel that supplies the ink stored in the ink tank 12 to the connection flow channel 14. One end of the inlet flow channel 13 is detachably connected to the ink tank 12. The other end of the inlet flow channel 13 is connected to the connection flow channel 14. In the present preferred embodiment, the inlet flow channel 13 includes a first inlet section 13*a* and a second inlet section 13*b*. The first inlet section 13*a* includes one end of the inlet flow channel 13. The first inlet section 13*a* is detachably connected to the ink tank 12. The first inlet section 13*a* is structured to prevent ink from leaking from one end of the inlet flow channel 13 when the ink tank 12 is removed from the one end of the inlet flow channel 13. The second inlet section 13*b* includes the other end of the inlet flow channel 13. The second inlet section 13*b* is connected to the connection flow channel 14.

The connection flow channel 14 is a flow channel that supplies the ink supplied to the inlet flow channel 13 to the upstream flow channel 15. The connection flow channel 14 is a flow channel that connects the inlet flow channel 13 and the upstream flow channel 15 to each other. One end of the connection flow channel 14 is connected to the other end of the inlet flow channel 13. In the present preferred embodiment, the one end of the connection flow channel 14 is provided with a three-way valve 42. The one end of the connection flow channel 14 is connected to the other end of the inlet flow channel 13 via the three-way valve 42. The other end of the connection flow channel 14 is connected to the upstream flow channel 15. Herein, the connection flow channel 14 includes a first connection section 14*a* and a second connection section 14*b*. The first connection section 14*a* includes the one end of the inlet flow channel 14. The first connection section 14*a* is connected to the second inlet section 13*b* via the three-way valve 42. The second connection section 14*b* includes the other end of the inlet flow channel 14. The second connection section 14*b* is connected to the upstream flow channel 15.

The upstream flow channel 15 is a flow channel that supplies the ink supplied to the connection flow channel 14 to the ink head 11. One end of the upstream flow channel 15 is connected to the other end of the connection flow channel 14. Herein, a three-way valve 43 is provided at the one end of the upstream flow channel 15. The one end of the upstream flow channel 15 is connected to the other end of the connection flow channel 14 via the three-way valve 43. The other end of the upstream flow channel 15 is connected to the ink head 11. In the present preferred embodiment, the upstream flow channel 15 includes a first upstream section 15*a*, a second upstream section 15*b*, and a middle upstream section 15*c*. The first upstream section 15*a* includes the one end of the upstream flow channel 15. The first upstream section 15*a* is connected to the second connection section 14*b* via the three-way valve 43. The second upstream section 15*b* includes the other end of the upstream flow channel 15. The second upstream section 15*b* is connected to the ink head 11. The middle upstream section 15*c* is positioned between the first upstream section 15*a* and the second upstream section 15*b*. The middle upstream section 15*c* is connected to the first upstream section 15*a* and the second upstream section 15*b*.

The downstream flow channel 16 is a flow channel into which the ink within the ink head 11 flows out from the ink head 11. The downstream flow channel 16 is a flow channel that causes the ink within the ink head 11 to flow to the connection flow channel 14. Herein, one end of the downstream flow channel 16 is connected to the ink head 11. The other end of the downstream flow channel 16 is connected to one end of the connection flow channel 14. More specifically, the other end of the downstream flow channel 16 is connected to the one end of the connection flow channel 14 and the other end of the inlet flow channel 13 via the three-way valve 42. In the present preferred embodiment, the downstream flow channel 16 includes a first downstream section 16*a*, a second downstream section 16*b*, and a middle downstream section 16*c*. The first downstream section 16*a* includes the one end of the downstream flow channel 16. The first downstream section 16*a* is connected to the ink head 11. The second downstream section 16*b* includes the other end of the downstream flow channel 16. The second downstream section 16*b* is connected to the second inlet section 13*b* and the first connection section 14*a* via the three-way valve 43. The middle downstream section 16*c* is positioned between the first downstream section 16*a* and the second downstream section 16*b*. The middle downstream section 16*c* is connected to the first downstream section 16*a* and the second downstream section 16*b*.

The outlet flow channel 17 is a flow channel that drains the ink within the inlet flow channel 13, the connection flow channel 14, the upstream flow channel 15, and the downstream flow channel 16, out of these flow channels. One end of the outlet flow channel 17 is connected to the other end of the connection flow channel 14. More specifically, the one end of the outlet flow channel 17 is connected to the other end of the connection flow channel 14 and the one end of the upstream flow channel 15 via the three-way valve 43. In the present preferred embodiment, the other end of the outlet flow channel 17 is connected to a waste ink tank 29. The waste ink tank 29 is a tank into which ink is drained when the ink flowing through the ink flow channel 20, for example, of the ink supply system 10 is discharged.

In the present preferred embodiment, the outlet flow channel 17 includes a first outlet section 17*a*, a second outlet section 17*b*, and a middle outlet section 17*c*. The first outlet section 17*a* includes one end of the outlet flow channel 17. The first outlet section 17*a* is connected to the second connection section 14*b* and the first upstream section 15*a* via the three-way valve 43. The second outlet section 17*b* includes the other end of the outlet flow channel 17. The second outlet section 17*b* is connected to the waste ink tank 29. The middle outlet section 17*c* is positioned between the first outlet section 17*a* and the second outlet section 17*b*. The middle outlet section 17*c* is connected to the first outlet section 17*a* and the second outlet section 17*b*.

In the present preferred embodiment, the ink flow channel 20 may be defined by a tube having flexibility. More specifically, each of the inlet flow channel 13, the connection flow channel 14, the upstream flow channel 15, the downstream flow channel 16, and the outlet flow channel 17 may be defined by a tube having flexibility. However, the type and material of the inlet flow channel 13, the connection flow channel 14, the upstream flow channel 15, the downstream flow channel 16, and the outlet flow channel 17 are not limited to a particular type or a particular material.

Next, the upstream pump 21 and the downstream pump 22 will be described. The upstream pump 21 and the downstream pump 22 serve to supply ink. The upstream pump 21 is a pump to supply ink toward the ink head 11, and the upstream pump 21 adjusts the flow rate of the ink flowing into the ink head 11. The downstream pump 22 is a pump to recirculate the ink that has flowed out of the ink head 11 and thereby allowing the ink to flow into the connection flow channel 14. The downstream pump 22 adjusts the flow rate of the ink flowing out from the ink head 11. In the present preferred embodiment, the upstream pump 21 is provided in the upstream flow channel 15. More specifically, the upstream pump 21 is provided between the first upstream section 15*a* and the middle upstream section 15*c* of the upstream flow channel 15. The downstream pump 22 is provided in the downstream flow channel 16. More specifically, the downstream pump 22 is provided between the middle downstream section 16*c* and the second downstream section 16*b* of the downstream flow channel 16. Herein, the ink head 11 is disposed between the upstream pump 21 and the downstream pump 22. Accordingly, the flow rate of ink is adjusted by the upstream pump 21, whereby the pressure in the flow channel upstream of the ink head 11 (which is the upstream flow channel 15 herein) is adjusted. The pressure in the flow channel downstream of the ink head 11 (which is the downstream flow channel 16 herein) is adjusted by the downstream pump 22. Thus, by adjusting the pressures in the flow channels upstream and downstream of the ink head 11, the pressure in the ink head 11 is adjusted, so that the ink is ejected according to the pressure in the ink head 11.

In the present preferred embodiment, the type of the upstream pump 21 and the type of the downstream pump 22 are the same. Herein, both the upstream pump 21 and the downstream pump 22 are a diaphragm pump. In the present preferred embodiment, the upstream pump 21 and the downstream pump 22 have the same structure. For this reason, the structure of the upstream pump 21 will be described in detail herein, and the detailed description of the structure of the downstream pump 22 will be omitted.

In the following description, the term "height" refers to a distance along the gravitational direction (i.e., the vertical direction) when the ink supply system 10 and the upstream pump 21 (or the downstream pump 22) are arranged properly in a predetermined posture at a predetermined position. In the drawings depicting the upstream pump 21, reference characters F1, Rr1, L1, R1, U1, and D1 respectively represent front, rear, left, right, up, and down when the upstream pump 21 is viewed from the front. In the present preferred embodiment, the term "first direction D11" refers to a leftward/rightward direction in the upstream pump 21 (or the downstream pump 22). The term "second direction D12" refers to a frontward/rearward direction in the upstream pump 21 (or the downstream pump 22).

Figure 3:
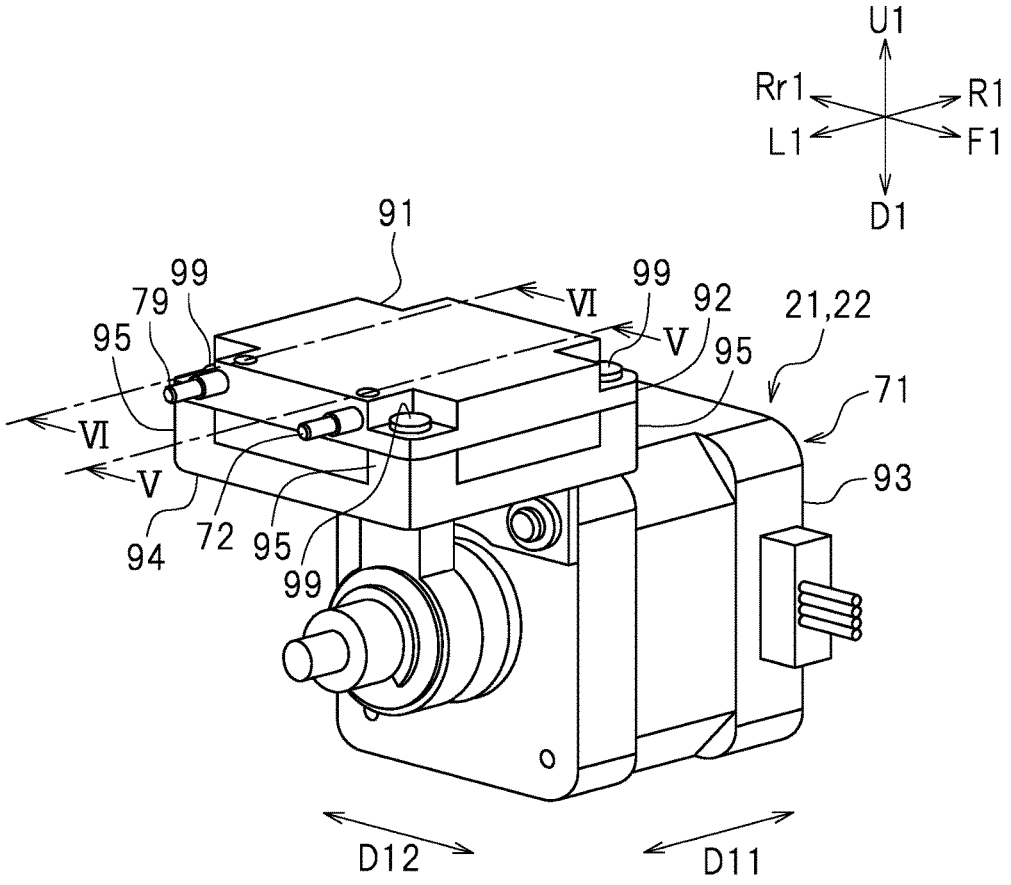
FIG. 3 is a perspective view illustrating an upstream pump.
Figure 4:
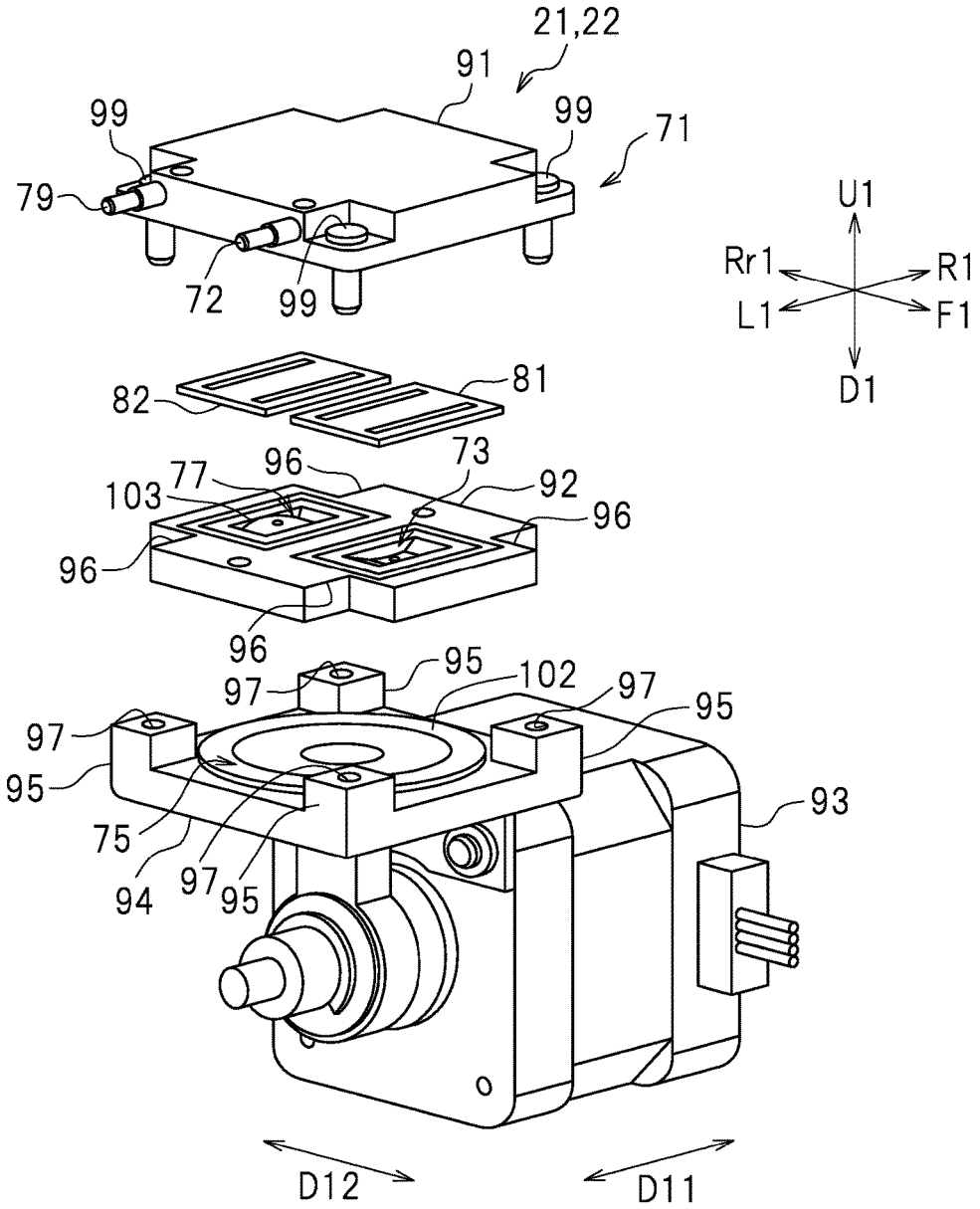
FIG. 4 is a perspective view of the upstream pump, illustrating an exploded view in which a first member, a second member, and a third member are disassembled.
Figure 5:
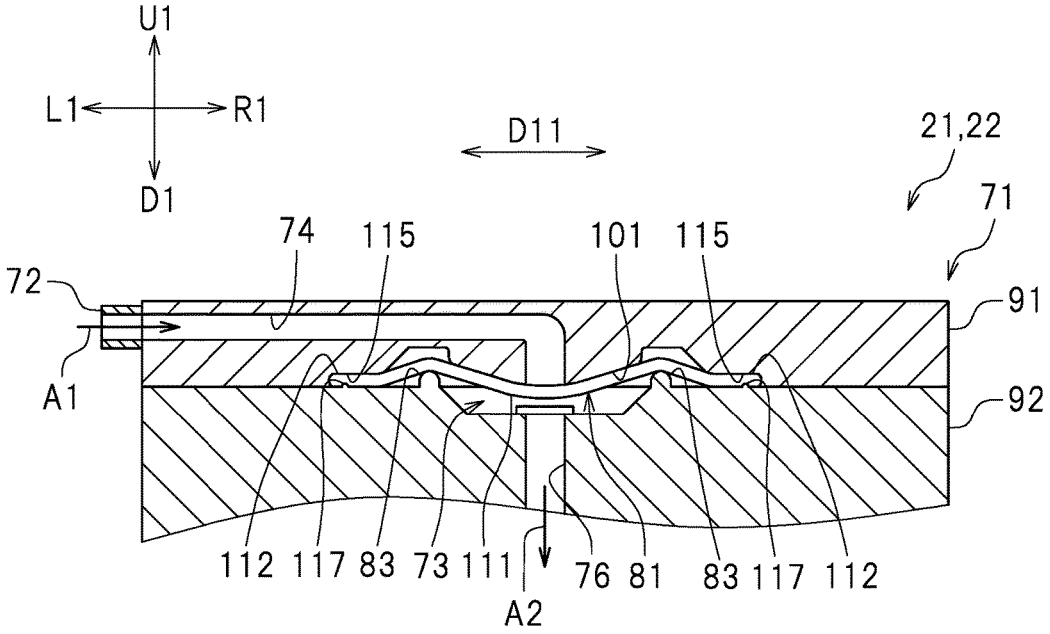
FIG. 5 is a cross-sectional view taken along line V-V in FIG. 3, which illustrates an inflow chamber.
Figure 6:
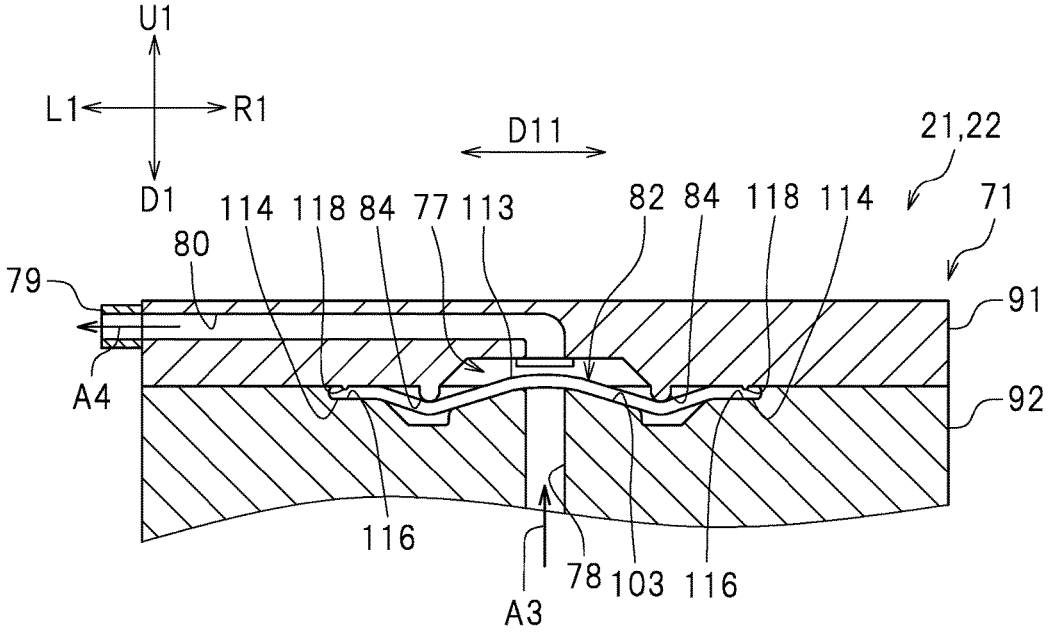
FIG. 6 is a cross-sectional view taken along line VI-VI in FIG. 3, which illustrates an outflow chamber.

FIG. 3 is a perspective view of the upstream pump 21. FIG. 4 is a perspective view of the upstream pump 21, illustrating a first member 91, a second member 92, and a third member 93, disassembled in an exploded view. FIG. 5 is a cross-sectional view taken along line V-V in FIG. 3, which shows an inflow chamber 73. FIG. 6 is a cross-sectional view taken along line VI-VI in FIG. 3, which shows an outflow chamber 77. In the present preferred embodiment, as illustrated in FIG. 3, the upstream pump 21 includes a main body 71, an inflow port 72, an inflow chamber 73 (see FIG. 5), a first inlet flow passage 74 (see FIG. 5), a pumping chamber 75 (see FIG. 4), a second inlet flow passage 76 (see FIG. 5), an outflow chamber 77 (see FIG. 6), a first outlet flow passage 78 (see FIG. 6), an outflow port 79, a second outlet flow passage 80 (see FIG. 6), an inflow valve 81 (see FIG. 4), an outflow valve 82 (see FIG. 4), inflow-valve pressers 83 (see FIG. 5), and outflow-valve pressers 84 (see FIG. 6).

As illustrated in FIGS. 5 and 6, provided inside the main body 71 are the inflow chamber 73, the first inlet flow passage 74, the pumping chamber 75, the second inlet flow passage 76, the outflow chamber 77, the first outlet flow passage 78, the second outlet flow passage 80, the inflow valve 81, the outflow valve 82, the inflow-valve pressers 83, and the outflow-valve pressers 84. In the present preferred embodiment, as illustrated in FIG. 4, the main body 71 includes a first member 91, a second member 92, and a third member 93. The first member 91, the second member 92, and the third member 93 are coupled vertically to each other. The first member 91, the second member 92, and the third member 93 are arranged and coupled to each other in that order from top to bottom.

The first member 91 is a plate with a rectangular or a substantially rectangular shape in plan view. The shape of the first member 91 is, however, not limited to a particular shape. The second member 92 is provided below the first member 91. The second member 92 is a plate with a rectangular or substantially rectangular shape in plan view. The shape of the second member 92 is, however, not limited to a particular shape. At the four corners of the second member 92, main-body notches 96 are provided and notched toward the center of the second member 92.

The third member 93 is provided below the second member 92. In the present preferred embodiment, an upper portion of the third member 93 is provided with a rectangular-shaped or substantially rectangular coupler 94. The second member 92 is disposed on the coupler 94. Herein, at the four corners of the coupler 94, rectangular or substantially rectangular parallelepiped-shaped main-body protuberances 95 protruding upward are provided respectively. When placing the second member 92 on the coupler 94 of the third member 93, the main-body protuberances 95 of the coupler 94 are fitted to the main-body notches 96 of the second member 92. This prevents the second member 92 from being displaced relative to the third member 93 when placing the second member 92 on the coupler 94 of the third member 93. When the second member 92 is placed on the coupler 94, the upper surface of the second member 92 and the upper surfaces of the main-body protuberances 95 become flush with each other. As illustrated in FIG. 3, when assembling the main body 71, the upper surfaces of the main-body protuberances 95 come into contact with the lower surface of the first member 91.

In the present preferred embodiment, first mating holes 97 are provided respectively in the upper surfaces of the four main-body protuberances 95 of the third member 93. Second mating holes (not shown) are provided at the four corners of the first member 91, in other words, in the portions of the first member 91 that correspond to the first mating holes 97 when the first member 91, the second member 92, and the third member 93 are coupled to each other. In the present preferred embodiment, with the first member 91, the second member 92 and the third member 93 coupled to each other in that order from top to bottom, screws 99 are inserted through the first mating holes 97 and the second mating holes. As a result, the first member 91 is secured to the third member 93, and the second member 92 is also secured to the third member 93. Thus, the first member 91 and the second member 92 are prevented from being displaced relative to the third member 93 in a frontward or rearward direction, a leftward or rightward direction, or an upward or downward direction.

The inflow port 72 allows ink to flow thereinto from outside the upstream pump 21. More specifically, the inflow port 72 allows ink to flow into the upstream pump 21 and defines and functions as an ink inlet of the upstream pump 21. In the present preferred embodiment, the inflow port 72 is provided in a side surface of the first member 91. The position of the inflow port 72 is, however, not limited to a particular position, and the inflow port 72 may be provided in the upper surface of the first member 91. It should be noted that in the case of the upstream pump 21, the inflow port 72 is connected to the first upstream section 15*a* (see FIG. 2) of the upstream flow channel 15 of the flow channel 20. On the other hand, in the case of the downstream pump 22, the inflow port 72 is connected to the middle downstream section 16*c* (see FIG. 2) of the downstream flow channel 16 of the flow channel 20.

As illustrated in FIG. 5, the inflow chamber 73 is a space into which the ink entering from the inflow port 72 flows. In the present preferred embodiment, the inflow chamber 73 is a space between the first member 91 and the second member 92. The inflow chamber 73 is provided with an inflow valve seat 101.

Figure 7:
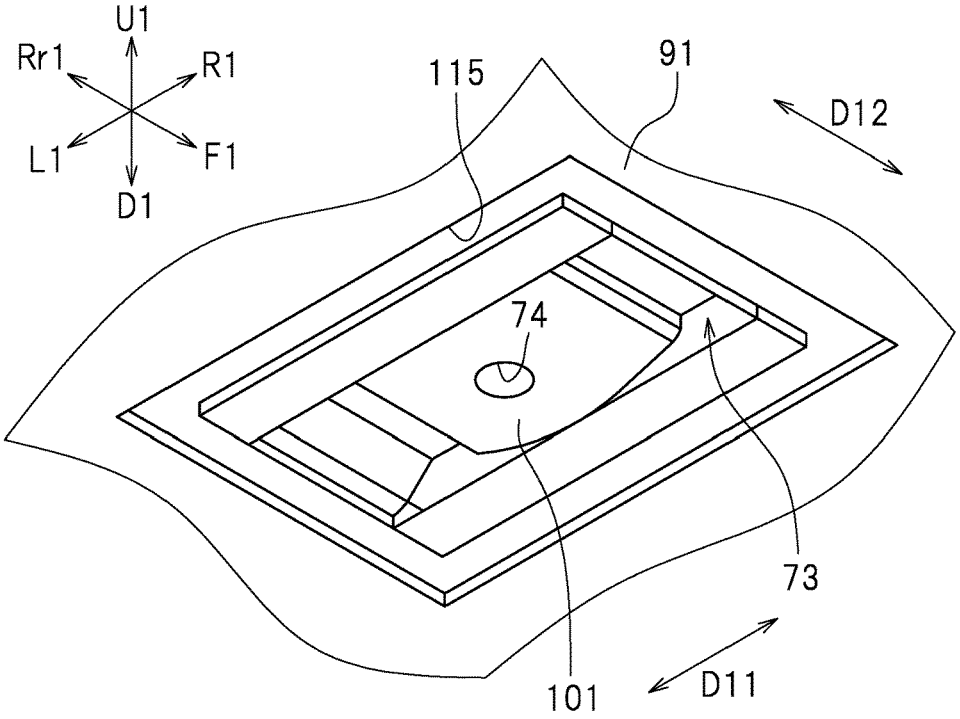
FIG. 7 is a perspective view of the first member, which illustrates an inflow valve seat.

The inflow valve 81 is disposed against the inflow valve seat 101. FIG. 7 is a perspective view of the first member 91, which illustrates the inflow valve seat 101. As illustrated in FIG. 7, in the present preferred embodiment, the inflow valve seat 101 is provided in the lower surface of the first member 91, which is the top surface of the inflow chamber 73 that faces the first member 91. As illustrated in FIG. 5, at least a portion of the surface of the inflow valve seat 101 is a curved surface. In the present preferred embodiment, the surface of the inflow valve seat 101 is a curved surface that is curved downwardly. More specifically, the surface of the inflow valve seat 101 is a curved surface that inclines (more specifically bends) downwardly toward a portion of the inflow valve seat 101, as arranged along the first direction D11, that connects with the downstream end of the first inlet flow passage 74. In other words, the surface of the inflow valve seat 101 is a curved surface that inclines downwardly toward a central portion of the inflow valve seat 101 as arranged along the first direction D11. It is also possible that a portion of the surface of the inflow valve seat 101 may be a curved surface while another portion thereof may be a flat surface. For example, a central portion of the surface of the inflow valve seat 101, as arranged along the first direction D11, may be a curved surface, and opposite end portions of the surface of the inflow valve seat 101, as arranged along the first direction D11, may be flat surfaces. It is also possible that the curved surface portion of the surface of the inflow valve seat 101 may have a constant curvature, or portions thereof may have different curvatures. In the present preferred embodiment, the height level of the lowest portion of the inflow valve seat 101 is at the same height level as the height level of the lower surface of the first member 91. It is possible, however, that the lowest portion of the inflow valve seat 101 may be at a lower level than the lower surface of the first member 91, or may be at a higher level than the lower surface of the first member 91.

The first inlet flow passage 74 is a flow passage that allows the inflow port 72 and the inflow chamber 73 to communicate with each other. The first inlet flow passage 74 is a flow passage that allows the ink entering from the inflow port 72 to flow to the inflow chamber 73. In the first inlet flow passage 74, ink flows in the direction indicated by arrow A1. In the present preferred embodiment, the first inlet flow passage 74 is provided inside the first member 91. The upstream end of the first inlet flow passage 74 is connected to the inflow port 72, which is provided in a side surface of the first member 91. The downstream end of the first inlet flow passage 74 is provided in the lower surface of the first member 91. Herein, the downstream end of the first inlet flow passage 74 is connected to the top surface of the inflow chamber 73. More specifically, as illustrated in FIG. 7, the downstream end of the first inlet flow passage 74 is connected to a central portion of the inflow valve seat 101 disposed in the inflow chamber 73.

As illustrated in FIG. 4, the pumping chamber 75 is a space in which a diaphragm 102 is actuated. The diaphragm 102 is provided in the pumping chamber 75. The diaphragm 102 causes the ink to flow from an inflow end to an outflow end. The diaphragm 102 defines at least a portion of the bottom surface of the pumping chamber 75. The diaphragm 102 is defined by a member that is elastically deformable in upward and downward directions. For example, the diaphragm 102 is defined by an elastomer (such as EDPM). In the present preferred embodiment, the pumping chamber 75 is a space between the second member 92 and the third member 93. More specifically, the pumping chamber 75 is defined by a space between the second member 92 and the coupler 94 of the third member 93.

As illustrated in FIG. 5, the second inlet flow passage 76 is a flow passage that allows the inflow chamber 73 and the pumping chamber 75 to communicate with each other. The second inlet flow passage 76 is a flow passage that allows the ink entering the inflow chamber 73 to flow to the pumping chamber 75. In the second inlet flow passage 76, ink flows in the direction indicated by arrow A2. In the present preferred embodiment, the second inlet flow passage 76 is provided inside the second member 92 of the main body 71. Herein, the second inlet flow passage 76 extends along an upward/downward direction. The upstream end of the second inlet flow passage 76 is provided in the upper surface of the second member 92. In other words, the upstream end of the second inlet flow passage 76 is connected to the inflow chamber 73. The downstream end of the second inlet flow passage 76 is provided in the lower surface of the second member 92. In other words, the downstream end of the second inlet flow passage 76 is connected to the pumping chamber 75 (see FIG. 4).

As illustrated in FIG. 6, the outflow chamber 77 is a space in which the ink that has flowed out of the pumping chamber 75 flows. In the present preferred embodiment, the outflow chamber 77 is, like the inflow chamber 73, a space between the first member 91 and the second member 92. The outflow chamber 77 is disposed so as to be lined up with the inflow chamber 73 along a frontward/rearward direction. Herein, the outflow chamber 77 is provided with an outflow valve seat 103.

Figure 8:
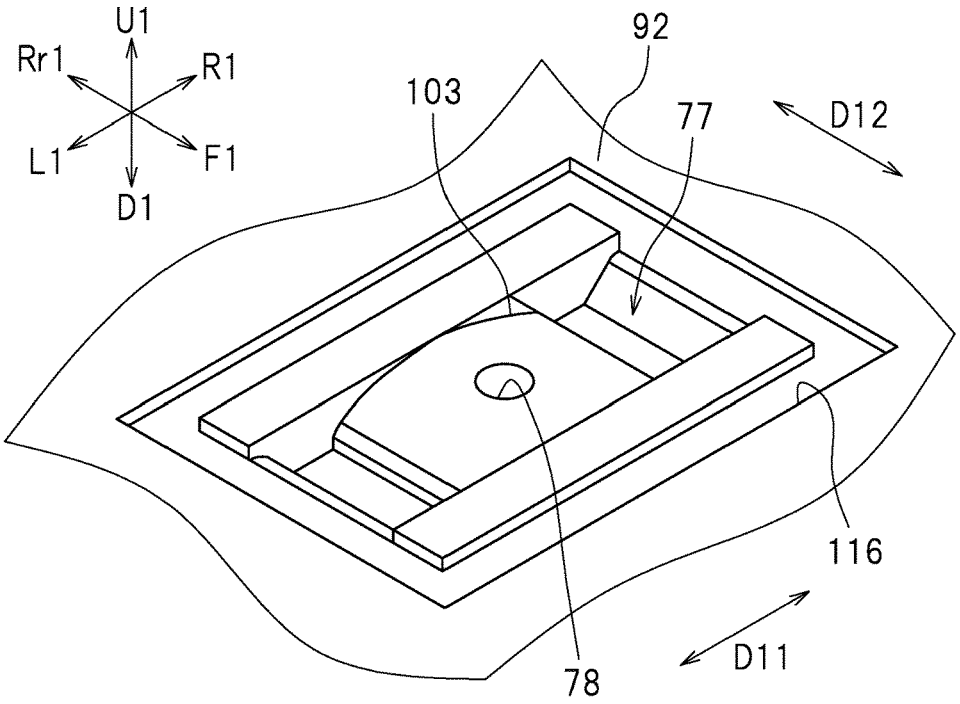
FIG. 8 is a perspective view of the second member, which illustrates an outflow valve seat.

The outflow valve 82 is disposed against the outflow valve seat 103. FIG. 8 is a perspective view of the second member 92, which illustrates the outflow valve seat 103. As illustrated in FIG. 8, in the present preferred embodiment, the outflow valve seat 103 is provided in the upper surface of the second member 92, which is the bottom surface of the outflow chamber 77 that faces the second member 92. In the present preferred embodiment, the outflow valve seat 103 has the same shape as that of the inflow valve seat 101. However, the outflow valve seat 103 may have a shape that is different from that of the inflow valve seat 101. As illustrated in FIG. 6, at least a portion of the surface of the outflow valve seat 103 is a curved surface. In the present preferred embodiment, the surface of the outflow valve seat 103 is a curved surface that is curved upwardly. More specifically, the surface of the outflow valve seat 103 is a curved surface that inclines (more specifically bends) upwardly toward a portion of the outflow valve seat 103, as arranged along the first direction D11, that connects with the downstream end of the first outlet flow passage 78. In other words, the surface of the outflow valve seat 103 is a curved surface that inclines upwardly toward a central portion of the outflow valve seat 103 as arranged along the first direction D11. It is also possible that a portion of the surface of the outflow valve seat 103 as arranged along the first direction D11 may be a curved surface while another portion thereof may be a flat surface. For example, a central portion of the surface of the outflow valve seat 103 may be a curved surface, and opposite end portions of the surface of the outflow valve seat 103, as arranged along the first direction D11, may be flat surfaces. It is also possible that a curved surface portion of the surface of the outflow valve seat 103 may have a constant curvature, or may partially have different curvatures. In the present preferred embodiment, the height level of the highest portion of the outflow valve seat 103 is at the same height level as the height level of the upper surface of the second member 92. However, the highest portion of the outflow valve seat 103 may be at a higher level than the upper surface of the second member 92. Alternatively, the highest portion of the outflow valve seat 103 may be at a lower level than the upper surface of the second member 92.

The first outlet flow passage 78 is a flow passage that allows the pumping chamber 75 and the outflow chamber 77 to communicate with each other. The first outlet flow passage 78 is a flow passage that allows the ink exiting from the pumping chamber 75 to flow to the outflow chamber 77. In the first outlet flow passage 78, ink flows in the direction indicated by arrow A3. Herein, the first outlet flow passage 78 is, like the second inlet flow passage 76, provided inside the second member 92 of the main body 71. The first outlet flow passage 78 is provided inside the second member 92 of the main body 71 so as not to overlap the second inlet flow passage 76. The first outlet flow passage 78 extends along an upward/downward direction. Herein, the upstream end of the first outlet flow passage 78 is provided in the lower surface of the second member 92, and is connected to the pumping chamber 75 (see FIG. 4). The downstream end of the first outlet flow passage 78 is provided in the upper surface of the second member 92, and is connected to the outflow chamber 77. More specifically, the downstream end of the first outlet flow passage 78 is connected to a central portion of the outflow valve seat 103 provided in the outflow chamber 77.

The outflow port 79 allows the ink to flow out of the upstream pump 21. The outflow port 79 allows the ink within the upstream pump 21 to flow out therefrom, and the outflow port 79 serves as an ink outlet of the upstream pump 21. Herein, the outflow port 79 is provided in a side surface of the first member 91. More specifically, as illustrated in FIG. 3, the outflow port 79 is provided in the same side surface of the first member 91 as the side surface thereof in which the inflow port 72 is provided. The outflow port 79 is lined up with the inflow port 72 along a second direction D12. However, the position of the outflow port 79 is not limited to a particular position. In the case of the upstream pump 21, the outflow port 79 is connected to the middle upstream section 15*c* (see FIG. 2) of the upstream flow channel 15 of the flow channel 20. On the other hand, in the case of the downstream pump 22, the outflow port 79 is connected to the second downstream section 16*b* (see FIG. 2) of the downstream flow channel 16 of the flow channel 20.

As illustrated in FIG. 6, the second outlet flow passage 80 is a flow passage that allows the outflow chamber 77 and the outflow port 79 to communicate with each other. The second outlet flow passage 80 is a flow passage that allows the ink exiting from the outflow chamber 77 to flow to the outflow port 79. In the second outlet flow passage 80, ink flows in the direction indicated by arrow A4. In the present preferred embodiment, the second outlet flow passage 80 is provided inside the first member 91 so as not to overlap the first inlet flow passage 74. The upstream end of the second outlet flow passage 80 is provided in the lower surface of the first member 91. Herein, the upstream end of the second outlet flow passage 80 is connected to the outflow chamber 77. The downstream end of the second outlet flow passage 80 is connected to the outflow port 79, which is provided in a side surface of the first member 91.

Figure 9:
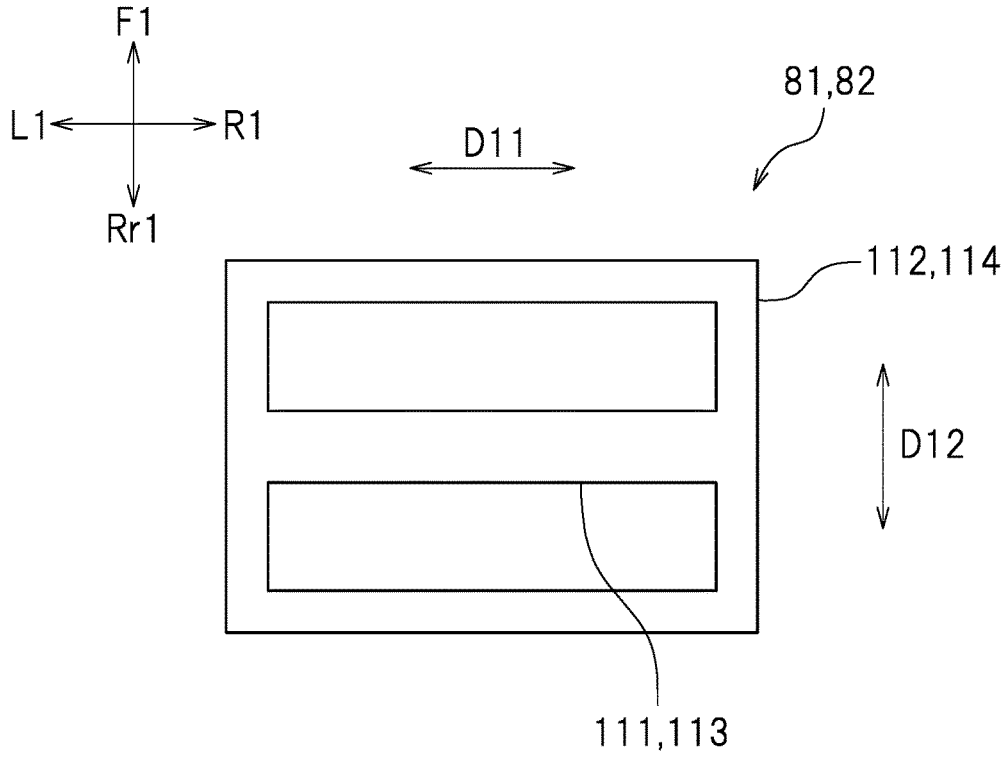
FIG. 9 is a plan view illustrating an inflow valve and an outflow valve.

Next, the inflow valve 81 and the outflow valve 82 will be described. As illustrated in FIG. 5, the inflow valve 81 is disposed against the inflow valve seat 101, and the inflow valve 81 is able to open and close the first inlet flow passage 74. In the present preferred embodiment, the inflow valve 81 is in a plate shape. FIG. 9 is a plan view illustrating the inflow valve 81 and the outflow valve 82. In the present preferred embodiment, as illustrated in FIG. 9, the inflow valve 81 preferably has a rectangular or substantially rectangular frame shape with a horizontal brace connecting two opposite sides of the frame. The inflow valve 81 includes an inflow plate 111 and an inflow frame 112.

As illustrated in FIG. 5, the inflow plate 111 is disposed against the inflow valve seat 101. As illustrated in FIG. 9, the inflow plate 111 extends along the first direction D11. The inflow frame 112 surrounds the inflow plate 111. Two opposite ends of the inflow plate 111 along the first direction D11 are connected to the inner peripheral surface of the inflow frame 112. The inflow frame 112 is a frame in which its outer peripheral shape and its inner peripheral shape are rectangular or substantially rectangular. Herein, the average thickness (average distance along the vertical direction herein) of the inflow plate 111 and the average thickness of the inflow frame 112 are equal or substantially equal. The average thickness of the inflow plate 111 may, however, be either thicker or thinner than the average thickness of the inflow frame 112.

As illustrated in FIG. 6, the outflow valve 82 is disposed against the outflow valve seat 103, and the outflow valve 82 is able to open and close the first inlet flow passage 78. In the present preferred embodiment, as illustrated in FIG. 9, the outflow valve 82 has the same shape as that of the inflow valve 81. However, the shape of the inflow valve 81 and the shape of the outflow valve 82 may be different from each other. Herein, the outflow valve 82 has a plate shape, and a rectangular or substantially rectangular frame shape with a horizontal brace connecting two opposite sides of the frame. The outflow valve 82 includes an outflow plate 113 and an outflow frame 114. As illustrated in FIG. 6, the outflow plate 113 is disposed against the outflow valve seat 103. As illustrated in FIG. 9, the outflow plate 113 extends along the first direction D11. The outflow frame 114 surrounds the outflow plate 113, and two opposite ends of the outflow plate 113 along the first direction D11 are connected to the inner peripheral surface of the outflow frame 114. Herein, the outflow frame 114 is a frame in which its outer peripheral shape and its inner peripheral shape are rectangular or substantially rectangular. The average thickness of the outflow plate 113 and the average thickness of the outflow frame 114 are equal or substantially equal. The average thickness of the outflow plate 113 may, however, be either thicker or thinner than the average thickness of the outflow frame 114.

Each of the inflow valve 81 and the outflow valve 82 is defined by an elastically deformable member. In other words, each of the inflow plate 111, the inflow frame 112, the outflow plate 113, and the outflow frame 114 is defined by an elastically deformable member. For example, the inflow valve 81 and the outflow valve 82 may be made of rubber. However, the inflow frame 112 and the outflow frame 114 may not be defined by an elastically deformable member. For example, both the inflow frame 112 and the outflow frame 114 may be defined by a metal.

Figure 10:
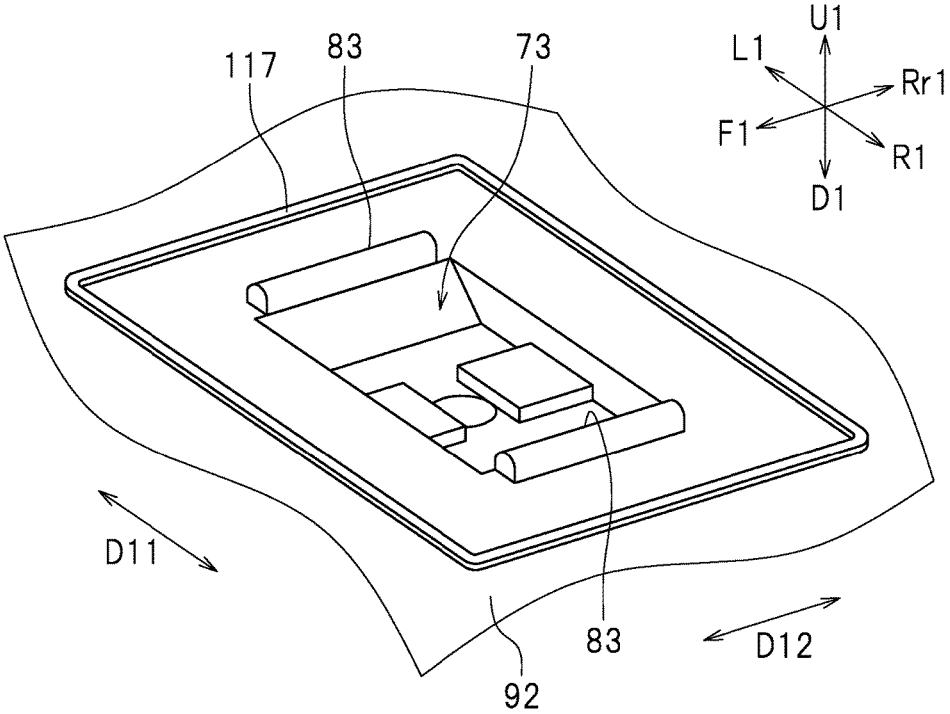
FIG. 10 is a perspective view of the second member, which illustrates an inflow-valve presser.

As illustrated in FIG. 5, the inflow-valve pressers 83 press the inflow valve 81 against the inflow valve seat 101 (toward the first member 91 herein). In the present preferred embodiment, each of the inflow-valve pressers 83 is a ridge on a portion of the second member 92 around the inflow chamber 73. Although the number of the inflow-valve pressers 83 is two herein, the number of the inflow-valve pressers 83 is not limited to a particular number. One of the inflow-valve pressers 83 presses one end portion of the inflow plate 111 of the inflow valve 81, as arranged along the first direction D11, against the inflow valve seat 101. FIG. 10 is a perspective view of the second member 92, which illustrates the inflow-valve pressers 83. As illustrated in FIG. 10, one of the inflow-valve pressers 83 extends along the second direction D12 and is provided in a portion of the upper surface of the second member 92 that is located leftward relative to the inflow chamber 73. The other one of the inflow-valve pressers 83 presses the other end portion of the inflow plate 111, as arranged along the first direction D11, against the inflow valve seat 101. The other one of the inflow-valve pressers 83 extends along the second direction D12 and is provided in a portion of the upper surface of the second member 92 that is located rightward relative to the inflow chamber 73. Herein, the one of the inflow-valve pressers 83 and the other one of the inflow-valve pressers 83 are opposed to each other across the inflow chamber 73, which is defined by the second member 92. Each of the two inflow-valve pressers 83 are in a semi-cylindrical shape. The shape of the inflow-valve pressers 83 is, however, not limited to a particular shape. For example, the inflow-valve pressers 83 may be in a rectangular or substantially rectangular parallelepiped shape.

Figure 11:
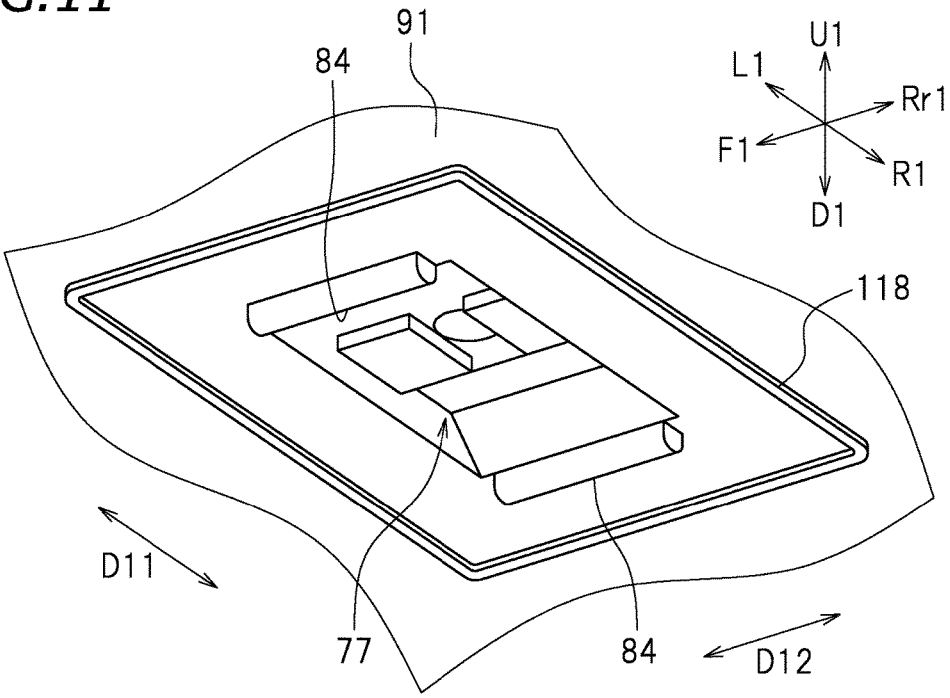
FIG. 11 is a perspective view of the first member, which illustrates an outflow-valve presser.

As illustrated in FIG. 6, the outflow-valve pressers 84 press the outflow valve 82 against the outflow valve seat 103 (toward the second member 92 herein). Herein, each of the outflow-valve pressers 84 is a ridge at a location that is around the portion of the first member 91 that defines the outflow chamber 77. In the present preferred embodiment, the number of outflow-valve pressers 84 is 2, the same as the number of inflow-valve pressers 83, but the number of outflow-valve pressers 84 is not limited to a particular number. One of the outflow-valve pressers 84 presses one end portion of the outflow plate 113 of the outflow valve 82, as arranged along the first direction D11, against the outflow valve seat 103. FIG. 11 is a perspective view of the first member 91, which illustrates the outflow-valve pressers 84. As illustrated in FIG. 11, one of the outflow-valve pressers 84 extends along the second direction D12. The one of the outflow-valve pressers 84 is provided in a portion of the lower surface of the first member 91 that is located leftward relative to the outflow chamber 77. The other one of the outflow-valve pressers 84 presses the other end portion of the outflow plate 113, as arranged along the first direction D11, against the outflow valve seat 103. The other one of the outflow-valve pressers 84 extends along the second direction D12 and is provided in a portion of the lower surface of the first member 91 that is located rightward relative to the outflow chamber 77. In the present preferred embodiment, the one of the outflow-valve pressers 84 and the other one of the outflow-valve pressers 84 are opposed to each other across the outflow chamber 77, which is defined by the first member 91. Each of the two outflow-valve pressers 84 are, like the inflow-valve pressers 83, in a semi-cylindrical shape. The shape of the outflow-valve pressers 84 is, however, not limited to a particular shape. For example, the outflow-valve pressers 84 may be in a rectangular or substantially rectangular parallelepiped shape.

In the present preferred embodiment, as illustrated in FIG. 7, an inflow groove 115 extends around the inflow valve seat 101 in the lower surface of the first member 91. In other words, the inflow groove 115 is provided in the lower surface of the first member 91 and around a portion of the first member 91 that defines the inflow chamber 73. The inflow frame 112 (see FIG. 9) of the inflow valve 81 fits into the inflow groove 115. For this reason, the inflow groove 115 has a shape corresponding to the shape of the inflow frame 112. Herein, both the outer peripheral shape and the inner peripheral shape of the inflow groove 115 are rectangular or substantially rectangular.

In the present preferred embodiment, as illustrated in FIG. 10, an inflow sealing rim 117 that presses the inflow frame 112 of the inflow valve 81 against the inflow groove 115 is provided in the upper surface of the second member 92. The inflow sealing rim 117 is provided on the upper surface of the second member 92 so as to face the inflow groove 115 when the first member 91 and the second member 92 are connected to each other. The inflow sealing rim 117 is a protruding rim protruding upward from the upper surface of the second member 92. In the present preferred embodiment, the inflow sealing rim 117 is in such a shape that a central portion of a rectangular or substantially rectangular plate member is cut out. Both the outer peripheral shape and the inner peripheral shape of the inflow sealing rim 117 are rectangular or substantially rectangular. The shape of the inflow sealing rim 117 is, however, not limited to a particular shape. For example, it is possible that a portion of the inflow sealing rim 117 may be grooved. Herein, as illustrated in FIG. 5, the upper end of the inflow sealing rim 117 makes contact with the inflow frame 112 that fits into the inflow groove 115.

As illustrated in FIG. 8, an outflow groove 116 is provided around the outflow valve seat 103 in the upper surface of the second member 92. The outflow groove 116 is provided in the upper surface of the second member 92 and around a portion of the second member 92 that forms the outflow chamber 77. Herein, the outflow frame 114 (see FIG. 9) of the outflow valve 82 fits into the outflow groove 116. For this reason, the outflow groove 116 has a shape corresponding to the shape of the outflow frame 114. In the present preferred embodiment, both the outer peripheral shape and the inner peripheral shape of the outflow groove 116 are, like the inflow groove 115, rectangular or substantially rectangular.

In the present preferred embodiment, as illustrated in FIG. 11, an outflow sealing rim 118 that presses the outflow frame 114 of the outflow valve 82 against the outflow groove 116 is provided in the lower surface of the first member 91. The outflow sealing rim 118 is provided on the lower surface of the first member 91 so as to face the outflow groove 116 when the first member 91 and the second member 92 are connected to each other. The outflow sealing rim 118 is a protruding rim protruding downward from the lower surface of the first member 91. In the present preferred embodiment, the outflow sealing rim 118 is, like the inflow sealing rim 117, in such a shape that a central portion of a rectangular or substantially rectangular plate member is cut out. Both the outer peripheral shape and the inner peripheral shape of the outflow sealing rim 118 are rectangular or substantially rectangular. The shape of the outflow sealing rim 118 is, however, not limited to a particular shape. For example, it is possible that a portion of the outflow sealing rim 118 may be grooved. The outflow sealing rim 118 may be either in the same shape as that of the inflow sealing rim 117 or in a different shape from that of the inflow sealing rim 117. Herein, as illustrated in FIG. 6, the lower end of the outflow sealing rim 118 makes contact with the outflow frame 114 that fits into the outflow groove 116.

Although not shown in the drawings in the present preferred embodiment, it is possible that the inside of the third member 93 may be provided with a feeding mechanism 119 (see FIG. 12) that supplies ink by causing the diaphragm 102 to deform in upward and downward directions. The configuration of the feeding mechanism 119 is not limited to a particular configuration. For example, the feeding mechanism 119 includes a shaft that is contactable with the diaphragm 102 and movable in upward and downward directions, and a pump motor that is connected to the shaft and causes the shaft to move in upward and downward directions. In the present preferred embodiment, the phrases "the upstream pump 21 is actuated" and "the downstream pump 22 is actuated" each mean a state in which the pump motor is actuated and the diaphragm 102 is elastically deformed.

In the present preferred embodiment, as illustrated in FIG. 2, the inflow port 72 of the upstream pump 21 may be provided with an upstream filter 44 to capture impurities such as dregs in the ink flow channel 20. This reduces the risk of problems resulting from entry of impurities into the upstream pump 21. Likewise, the inflow port 72 of the downstream pump 22 may also be provided with a downstream filter 45 to capture impurities in the ink flow channel 20. This reduces the risk of problems resulting from entry of impurities into the downstream pump 22.

Next, the upstream damper 23 and the downstream damper 24 will be described. The upstream damper 23 and the downstream damper 24 alleviate ink pressure fluctuations to stabilize the ink ejection operation of the ink head 11. The upstream damper 23 is capable of detecting the flow rate of the ink flowing into the upstream damper 23. The actuation of the upstream pump 21 is controlled based on the flow rate detected by the upstream damper 23. The downstream damper 24 is capable of detecting the flow rate of the ink flowing into the downstream damper 24. The actuation of the downstream pump 22 is controlled based on the flow rate detected by the downstream damper 24.

In the present preferred embodiment, the upstream damper 23 is provided in the upstream flow channel 15. More specifically, the upstream damper 23 is provided at a portion of the upstream flow channel 15 that is closer to the ink head 11 than is the upstream pump 21. In the present preferred embodiment, the upstream damper 23 is provided between the middle upstream section 15*c* and the second upstream section 15*b* of the upstream flow channel 15. The downstream damper 24 is provided in the downstream flow channel 16. More specifically, the downstream damper 24 is provided at a portion of the downstream flow channel 16 that is closer to the ink head 11 than is the downstream pump 22. In the present preferred embodiment, the downstream damper 24 is provided between the first downstream section 16*a* and the middle downstream section 16*c* of the downstream flow channel 16.

In the present preferred embodiment, each of the upstream damper 23 and the downstream damper 24 includes an ink reservoir chamber 47 that stores ink, and a detection sensor 48 that detects whether or not the amount of ink stored in the ink reservoir chamber 47 is equal to or less than a predetermined storage amount. For example, the detection sensor 48 may be a photo interrupter. For example, if, in the upstream damper 23, the detection sensor 48 detects that the amount of ink stored in the ink reservoir chamber 47 is equal to or less than the predetermined storage amount, the operation of the upstream pump 21 is controlled so as to increase the ink flow rate through the upstream pump 21. On the other hand, if, in the upstream damper 23, the amount of ink stored in the ink reservoir chamber 47 is greater than the predetermined storage amount, the operation of the upstream pump 21 is controlled so as to decrease the ink flow rate through the upstream pump 21.

Likewise, if, in the downstream damper 24, the detection sensor 48 detects that the amount of ink stored in the ink reservoir chamber 47 is equal to or less than a predetermined storage amount, the operation of the downstream pump 22 is controlled so as to increase the ink flow rate through the downstream pump 22. On the other hand, if, in the downstream damper 24, the amount of ink stored in the ink reservoir chamber 47 is greater than the predetermined storage amount, the operation of the downstream pump 22 is controlled so as to decrease the ink flow rate through the downstream pump 22.

It should be noted that the upstream damper 23 and the downstream damper 24 may be provided in one damper main body (not shown). The upstream damper 23 and the downstream damper 24 may be provided in the damper main body so that the components that define the upstream damper 23 and the components that define the downstream damper 24 do not overlap each other. In the present preferred embodiment, the damper main body is provided on the upper surface of the ink head 11 and is mounted on the carriage 4. As illustrated in FIG. 1, the upstream dampers 23 and the downstream dampers 24 are disposed on the upper surfaces of the ink heads 11 and are mounted on the carriage 4.

Additionally, the upstream damper 23 may be provided with a damper filter (not shown) to capture dust such as dregs within the ink flow channel 20. This prevents impurities that may be contained in the ink from entering the second upstream section 15*b* of the upstream flow channel 15 and the ink head 11. In addition, as illustrated in FIG. 2, the upstream damper 23 may be provided with a thermistor 32 that detects the temperature of the ink in the upstream flow channel 15.

The air trap 25 is a device that collects the air contained in the ink supply system 10 and discharges the collected air out of the ink flow channel 20. The air trap 25 is provided in the connection flow channel 14. More specifically, the air trap 25 is provided between the first connection section 14*a* and the second connection section 14*b* in the connection flow channel 14. The air trap 25 includes, for example, an ink pouch 33 that is able to store ink and the air contained in the ink, and a discharge mechanism 34 that discharges the air contained in the ink pouch 33 out of the ink pouch 33. Note that herein, the phrase "the air trap 25 is stopped" means a state in which the air inside the air trap 25 is not discharged and the air is stored in the air trap 25. The phrase "the air trap 25 is actuated" means a state in which the air stored in the air trap 25 is being discharged.

It should be noted that in the present preferred embodiment, the air trap 25 may also include a thermistor 35*a* and a heater 35*b*. The thermistor 35*a* detects the temperature of the ink within the ink pouch 33 of the air trap 25. The heater 35*b* heats the ink within the ink pouch 33 of the air trap 25.

The inlet valve 26 is a valve that opens and closes the inlet flow channel 13. The inlet valve 26 opens the inlet flow channel 13 to thereby permit the ink stored in the ink tank 12 to be supplied to the ink head 11. The inlet valve 26 closes the inlet flow channel 13 to thereby prohibit the ink stored in the ink tank 12 from flowing to the ink head 11. In the present preferred embodiment, the term "open" may mean to include, for example, cases in which the flow channel to be opened and closed is not completely opened but a portion of the flow channel is opened, in addition to a case in which the flow channel to be opened and closed is completely opened. When the condition in which the flow channel to be opened and closed is completely opened is taken as 100%, the term "open" may mean to include, for example, an approximately 80% open state, or an approximately 90% open state. Depending on the configuration of the ink supply system 10, it is possible that the term "open" may mean to include, for example, an approximately 10% open state. In the present preferred embodiment, it is preferable that the term "closed" mean that the flow channel to be opened and closed is completely closed. That said, depending on the configuration of the ink supply system 10, it is also possible that the term "closed" may mean to include a state in which a very small portion of the flow channel to be opened and closed is opened. When the state in which the flow channel to be opened and closed is completely opened is taken as 100%, it is possible that the term "closed" may mean to include, for example, an approximately 1% open state, depending on the configuration of the ink supply system 10. In the present preferred embodiment, the inlet valve 26 is provided in the inlet flow channel 13. More specifically, the inlet valve 26 is provided between the first inlet section 13*a* and the second inlet section 13*b* of the inlet flow channel 13. Although the type of the inlet valve 26 is not limited to a particular type of valve, the inlet valve 26 herein is a choke valve.

The outlet valve 27 is a valve that opens and closes the outlet flow channel 17. The outlet valve 27 opens the outlet flow channel 17 to thereby permit the ink within the ink flow channel 20 to be discharged out of the ink flow channel 20. The outlet valve 27 closes the outlet flow channel 17 to thereby prohibit the ink within the ink flow channel 20 from being discharged out of the ink flow channel 20. In the present preferred embodiment, the outlet valve 27 is provided in the outlet flow channel 17. More specifically, the outlet valve 27 is provided between the first outlet section 17*a* and the middle outlet section 17*c* of the outlet flow channel 17. Note that the type of the outlet valve 27 is not limited to a particular type. In the present preferred embodiment, the outlet valve 27 is a choke valve, like the inlet valve 26. The outlet valve 27 may be the same type of valve as the inlet valve 26, or may be a different type of valve from the inlet valve 26.

The outlet pump 28 causes the ink, the air contained in the ink, or the like within the ink flow channel 20 to flow to the waste ink tank 29 in a condition in which the outlet flow channel 17 is opened by the outlet valve 27. The outlet pump 28 is provided in the outlet flow channel 17. More specifically, the outlet pump 28 is provided at a portion of the outlet flow channel 17 that is closer to the waste ink tank 29 than is the outlet valve 27. In the present preferred embodiment, the outlet pump 28 is provided between the middle outlet section 17*c* and the second outlet section 17*b* of the outlet flow channel 17. Although the type of the outlet pump 28 is not limited to a particular type, the outlet pump 28 herein is a tube pump. Although not shown in the drawings, the outlet pump 28 is connected to a motor. By actuating the motor, the outlet pump 28 is actuated.

Figure 12:
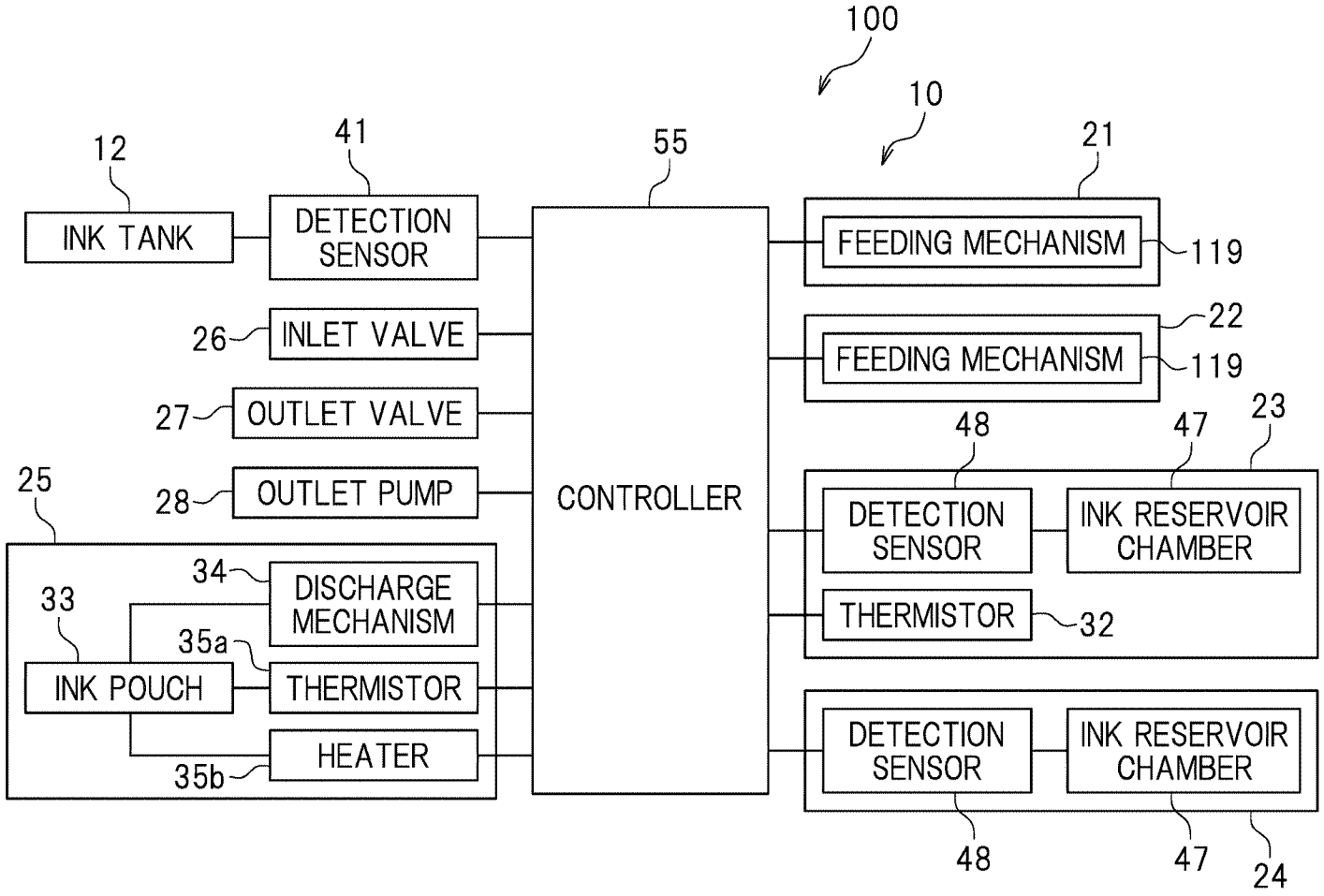
FIG. 12 is a block diagram illustrating the printer.

FIG. 12 is a block diagram of the printer 100. In the present preferred embodiment, the inkjet printer 10 includes a controller 55, as illustrated in FIG. 12. The controller 55 is a device that controls the ink supply systems 10. Herein, the controller 55 is a device that performs, for example, control of ink supply to the ink heads 11. The configuration of the controller 55 is not limited to a particular configuration. For example, the controller 55 may be a computer, and may include a central processing unit (hereinafter also referred to as "CPU"), a ROM that stores programs or the like to be executed by the CPU, and a RAM.

The controller 55 is connected to the detection sensor 41 provided in the ink tank 12, and with the detection sensor 41, the controller 55 detects the amount of ink stored in the ink tank 12. The controller 55 is connected to the feeding mechanism 119 of the upstream pump 21 and to the detection sensor 48 of the upstream damper 23. The detection sensor 48 of the upstream damper 23 detects the amount of ink stored in the ink reservoir chamber 47 of the upstream damper 23, and based on the detection result, the controller 55 controls the feeding mechanism 119 of the upstream pump 21. In addition, the controller 55 is connected to the feeding mechanism 119 of the downstream pump 22 and to the detection sensor 48 of the downstream damper 24. The detection sensor 48 of the downstream damper 24 detects the amount of ink stored in the ink reservoir chamber 47 of the downstream damper 24, and based on the detection result, the controller 55 controls the feeding mechanism 119 of the downstream pump 22.

The controller 55 is connected to the thermistor 32 provided on the upstream damper 23. The controller 55 detects the temperature of the ink within the upstream flow channel 15 via the thermistor 32. The controller 55 is connected to the discharge mechanism 34 of the air trap 25. When the air in the ink pouch 33 should be discharged, the controller 55 controls the discharge mechanism 34 so as to discharge the air. The controller 55 is connected to the thermistor 35*a* provided on the air trap 25. The controller 55 detects the temperature of the ink within the ink pouch 33 of the air trap 25 via the thermistor 35*a*. The controller 55 is connected to the heater 35*b* provided in the air trap 25. The controller 55 controls the heater 35*b* so as to heat the ink within the ink pouch 33. The controller 55 is connected to the inlet valve 26. The controller 55 controls opening and closing of the inlet flow channel 13 by controlling the inlet valve 26. The controller 55 is connected to the outlet valve 27. The controller 55 controls opening and closing of the outlet flow channel 17 by controlling the outlet valve 27. The controller 55 is connected to the outlet pump 28. The controller 55 causes the ink within the ink flow channel 20 to be drained into the waste ink tank 29 by controlling the outlet pump 28.

Hereinabove, the configuration of the printer 100 including the ink supply system 10 according to the present preferred embodiment has been described. Next, operation of the ink supply system 10 at the time of printing will be described. When printing, ink is ejected from the nozzle 11*a* of the ink head 11 toward the recording medium 5 placed on the platen 7. When printing, the ink stored in the ink tank 12 is supplied to the ink head 11. At this time, the controller 55 opens the inlet valve 26 and also closes the outlet valve 27. As a result, the inlet flow channel 13 is brought into an opened state, while the outlet flow channel 17 is brought into a closed state. Also, when printing, the controller 55 actuates the upstream pump 21 and the downstream pump 22. More specifically, the controller 55 controls actuation of the upstream pump 21 and the downstream pump 22 so that the pressure in the ink head 11 is brought to a negative pressure. This enables the nozzle 11*a* of the ink head 11 to eject ink. It should be noted that, during printing, the air trap 25 is stopped, and the outlet pump 28 is also stopped.

In the present preferred embodiment, when printing, because the inlet valve 26 is opened, the ink stored in the ink tank 12 is allowed to pass through the inlet flow channel 13 and flow into the connection flow channel 14. Meanwhile, because the outlet valve 27 is closed and also the upstream pump 21 and the downstream pump 22 are actuated, the ink in the connection flow channel 14 is not allowed to flow into the outlet flow channel 17 but is allowed to flow into the upstream flow channel 15. Then, by actuation of the upstream pump 21, the ink in the upstream flow channel 15 is supplied to the ink head 11. Because the ink head 11 is in a negative pressure state, a portion of the ink within the ink head 11 is ejected from the nozzle 11*a* toward the recording medium 5, and a portion of the remaining ink within the ink head 11 is caused to flow into the downstream flow channel 16 by actuation of the downstream pump 22. Then, the ink within the downstream flow channel 16 flows into the connection flow channel 14. Thus, at the time of printing, ink passes through the connection flow channel 14, the upstream flow channel 15, the ink head 11, and the downstream flow channel 16, to circulate through the ink flow channel 20.

Next, the following describes operations of the upstream pump 21 when the upstream pump 21 is actuated. The operations of the downstream pump 22 when it is actuated are the same as the operations of the upstream pump 21, and therefore not described in further detail herein.

First, when the upstream pump 21 is actuated, the pump motor of the feeding mechanism 119 (see FIG. 12) is actuated, and the diaphragm 102 is elastically deformed in upward and downward directions, as illustrated in FIG. 4. Herein, as illustrated in FIG. 5, when the diaphragm 102 is elastically deformed downward, the ink entering from the inflow port 72 passes through the inflow chamber 73 and flows into the pumping chamber 75. More specifically, the flow of the ink entering from the inflow port 72 presses the inflow plate 111 of the inflow valve 81 downward, thereby producing a gap between the inflow plate 111 and the inflow valve seat 101. Through the gap, ink flows into the inflow chamber 73. Thus, when the diaphragm 102 is elastically deformed downward, the ink entering from the inflow port 72 passes through the first inlet flow passage 74, the inflow chamber 73, and the second inlet flow passage 76, and flows into the pumping chamber 75, as indicated by arrows A1 an A2. Note that, as illustrated in FIG. 6, when the diaphragm 102 is elastically deformed downward, the outflow valve 82 defines and functions as a backflow prevention valve and the outflow plate 113 of the outflow valve 82 comes into in intimate contact with the outflow valve seat 103, bringing the first outlet flow passage 78 into a closed state. Therefore, when the diaphragm 102 is elastically deformed downward, ink does not flow toward the pumping chamber 75 from the outflow chamber 77, which is downstream of the pumping chamber 75.

On the other hand, when the diaphragm 102 is elastically deformed upward, the ink in the pumping chamber 75 passes through the outflow chamber 77 and flows out from the outflow port 79. More specifically, the flow of the ink flowing from the pumping chamber 75 toward the outflow port 79 presses the outflow plate 113 of the outflow valve 82 upward, thereby producing a gap between the outflow plate 113 and the outflow valve seat 103. Through the gap, the ink in the pumping chamber 75 flows into the outflow chamber 77. Thus, when the diaphragm 102 is elastically deformed upward, the ink in the pumping chamber 75 passes through the first outlet flow passage 78, the outflow chamber 77, and the second outlet flow passage 80, and then flows out from the outflow port 79, as indicated by arrows A3 an A4. Note that, as illustrated in FIG. 5, when the diaphragm 102 is elastically deformed upward, the inflow valve 81 functions as a backflow prevention valve and the inflow plate 111 of the inflow valve 81 comes into in intimate contact with the inflow valve seat 101, bringing the first outlet flow passage 74 into a closed state. Therefore, when the diaphragm 102 is elastically deformed upward, ink does not flow toward the inflow port 72 from the inflow chamber 73, which is upstream of the pumping chamber 75.

As described above, in the present preferred embodiment, when the diaphragm 102 is elastically deformed upward, the elastically deformable inflow valve 81 is elastically deformed along the curved surface of the inflow valve seat 101 and is placed onto the inflow valve seat 101. Thus, when the diaphragm 102 is elastically deformed upward, a gap is unlikely to be produced between the inflow valve 81 and the inflow valve seat 101. Therefore, the inflow valve 81 defines and functions as a backflow prevention valve. This prevents backflow of the ink in the first inlet flow passage 74 more effectively. Moreover, as illustrated in FIG. 6, when the diaphragm 102 is elastically deformed downward, the elastically deformable outflow valve 82 undergoes elastic deformation along the curved surface of the outflow valve seat 103 and sits on the outflow valve seat 103. Thus, when the diaphragm 102 is elastically deformed downward, a gap is unlikely to be produced between the outflow valve 82 and the outflow valve seat 103. Therefore, the outflow valve 82 defines and functions as a backflow prevention valve. This prevents backflow of the ink in the first outlet flow passage 78 more effectively.

In the present preferred embodiment, as illustrated in FIG. 5, the surface of the inflow valve seat 101, as arranged along the first direction D11 which is the same direction as the direction along which the inflow plate 111 extends, is a curved surface that inclines (i.e., bends herein) downwardly toward a portion of the inflow valve seat 101 that connects with the downstream end of the first inlet flow passage 74 (i.e., toward a central portion of the inflow valve seat 101 as arranged along the first direction D11 herein). As a result, it is easy to dispose the inflow plate 111 of the inflow valve 81 along the surface of the inflow valve seat 101, and moreover, when the diaphragm 102 is elastically deformed upward, a gap is more unlikely to be produced between the inflow valve 81 and the inflow valve seat 101. Therefore, ink is unlikely to flow backward into the first inlet flow passage 74.

Also in the present preferred embodiment, as illustrated in FIG. 5, the surface of the outflow valve seat 103, as arranged along the first direction D11 which is the same direction as the direction along which the outflow plate 113 extends, is a curved surface that inclines (i.e., bends herein) upwardly toward a portion of the outflow valve seat 103 that connects with the downstream end of the first outlet flow passage 78 (i.e., toward a central portion of the outflow valve seat 103 as arranged along the first direction D11 herein). As a result, it is easy to dispose the outflow plate 113 of the outflow valve 82 along the surface of the outflow valve seat 103, and moreover, when the diaphragm 102 is elastically deformed downward, a gap is more unlikely to be produced between the outflow valve 82 and the outflow valve seat 103. Therefore, ink is unlikely to flow backward from the outflow chamber 77 into the pumping chamber 75.

In the present preferred embodiment, as illustrated in FIG. 3, the inflow port 72 and the outflow port 79 are provided in the first member 91. As illustrated in FIGS. 5 and 6, the first inlet flow passage 74 and the second outlet flow passage 80 are provided inside the first member 91. Each of the inflow chamber 73 and the outflow chamber 77 is a space between the first member 91 and the second member 92. The pumping chamber 75 is a space between the second member 92 and the third member 93. This means that the inflow chamber 73 and the outflow chamber 77 are allowed to communicate with outside by removing the first member 91 from the second member 92. Accordingly, when the inflow valve 81 deteriorates, the inflow valve 81 may be easily taken out from the inflow valve seat 101, which is provided in the inflow chamber 73, by removing the first member 91 from the second member 92. Removing the first member 91 from the second member 92 enables the user to place the inflow valve 81 onto the inflow valve seat 101 easily. Likewise, when the outflow valve 82 deteriorates, the outflow valve 82 may be easily taken out from the outflow valve seat 103, which is provided in the outflow chamber 77, by removing the first member 91 from the second member 92. Removing the first member 91 from the second member 92 enables the user to place the outflow valve 82 onto the outflow valve seat 103 easily.

In the present preferred embodiment, as illustrated in FIG. 5, the inflow-valve pressers 83 are ridges that protrude upward from the upper surface of the second member 92 and that press opposite end portions of the inflow plate 111 of the inflow valve 81, as arranged along the first direction D11. Thus, when the second member 92 is fitted to the first member 91, the inflow plate 111 is pressed at two locations, its opposite end portions. As a result, the inflow plate 111 makes intimate contact with the inflow valve seat 101 easily.

In the present preferred embodiment, as illustrated in FIG. 7, the inflow groove 115 is provided in the first member 91 so as to surround a portion of the first member 91 in which the inflow chamber 73 is provided. The inflow frame 112 (see FIG. 9) of the inflow valve 81 fits into the inflow groove 115. This prevents the inflow valve 81 from being displaced relative to the inflow valve seat 101.

In the present preferred embodiment, the inflow sealing rim 117 that presses the inflow frame 112 of the inflow valve 81 against the inflow groove 115 is provided in the upper surface of the second member 92, as illustrated in FIG. 10. As a result, the inflow valve 81 is unlikely to be displaced relative to the inflow valve seat 101 when the first member 91 is fitted to the second member 92. Moreover, even when the inflow valve 81 is elastically deformed while the upstream pump 21 or the downstream pump 22 is being operated, the inflow valve 81 is unlikely to be displaced relative to the inflow valve seat 101 because the inflow frame 112 is pressed against the inflow groove 115.

In the present preferred embodiment, as illustrated in FIG. 6, the outflow-valve pressers 84 are ridges that protrude downward from the lower surface of the first member 91 and that press the opposite end portions of the outflow plate 113 of the outflow valve 82, as arranged along the first direction D11. Thus, when the first member 91 is fitted to the second member 92, the outflow plate 113 are pressed at two locations, its opposite end portions. As a result, the outflow plate 113 makes intimate contact with the outflow valve seat 103 easily.

In the present preferred embodiment, as illustrated in FIG. 8, the outflow groove 116 is provided in the second member 92 so as to surround a portion of the second member 92 in which the outflow chamber 77 is provided. Then, the outflow frame 114 (see FIG. 9) of the outflow valve 82 fits into the outflow groove 116. This prevents the outflow valve 82 from being displaced relative to the outflow valve seat 103.

In the present preferred embodiment, as illustrated in FIG. 11, an outflow sealing rim 118 that presses the outflow frame 114 of the outflow valve 82 against the outflow groove 116 is provided in the lower surface of the first member 91. As a result, the outflow valve 82 is unlikely to be displaced relative to the outflow valve seat 103 when the first member 91 is fitted to the second member 92. Moreover, even when the outflow valve 82 is elastically deformed while the upstream pump 21 or the downstream pump 22 is being operated, the outflow valve 82 is unlikely to be displaced relative to the outflow valve seat 103 because the outflow frame 114 is pressed against the outflow groove 116 by the outflow sealing rim 118.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A diaphragm pump comprising:

an inflow port that allows a liquid to flow therein from outside the diaphragm pump;

an inflow chamber provided with an inflow valve seat;

a first inlet flow passage that allows the inflow port and the inflow chamber to communicate with each other;

a pumping chamber in which an elastically deformable diaphragm is disposed;

a second inlet flow passage that allows the inflow chamber and the pumping chamber to communicate with each other;

an outflow chamber provided with an outflow valve seat;

a first outlet flow passage that allows the pumping chamber and the outflow chamber to communicate with each other;

an outflow port that allows the liquid to flow out of the diaphragm pump;

a second outlet flow passage that allows the outflow chamber and the outflow port to communicate with each other;

an inflow valve disposed against the inflow valve seat and causing the first inlet flow passage to open and close;

an outflow valve disposed against the outflow valve seat and causing the first outlet flow passage to open and close;

an inflow-valve presser that presses the inflow valve against the inflow valve seat; and an outflow-valve presser that presses the outflow valve against the outflow valve seat; wherein each of the inflow valve and the outflow valve is defined by an elastically deformable member; and each of the inflow valve seat and the outflow valve seat includes a surface at least a portion of which is a curved surface.

2. The diaphragm pump according to claim 1, wherein the inflow valve includes an inflow plate extending along a predetermined first direction and disposed against the inflow valve seat;

the inflow valve seat is provided in an upper surface of the inflow chamber;

the inflow valve seat is connected to a downstream end of the first inlet flow passage; and the inflow valve seat includes a surface that is a curved surface inclining downwardly toward a portion of the inflow valve seat, when arranged along the first direction, that connects with the downstream end of the first inlet flow passage.

3. The diaphragm pump according to claim 2, wherein the downstream end of the first inlet flow passage is connected to a central portion of the inflow valve seat when viewed in a plan view.

4. The diaphragm pump according to claim 1, wherein the outflow valve includes an outflow plate extending along a predetermined first direction and disposed against the outflow valve seat;

the outflow valve seat is provided in a lower surface of the outflow chamber;

the outflow valve seat is connected to a downstream end of the first outlet flow passage; and the outflow valve seat includes a surface that is a curved surface inclining upwardly toward a portion of the outflow valve seat, when arranged along the first direction, that connects with the downstream end of the first outlet flow passage.

5. The diaphragm pump according to claim 4, wherein the downstream end of the first outlet flow passage is connected to a central portion of the outflow valve seat when viewed in a plan view.

6. The diaphragm pump according to claim 1, further comprising:

a main body including at least a first member and a second member provided below the first member; wherein each of the inflow port and the outflow port is provided in the first member; and each of the first inlet flow passage and the second outlet flow passage is provided inside the first member; and each of the inflow chamber and the outflow chamber is a space between the first member and the second member.

7. The diaphragm pump according to claim 6, wherein the main body further includes a third member provided below the second member;

the pumping chamber is a space between the second member and the third member; and the diaphragm defines a lower surface of the pumping chamber and is elastically deformable in upward and downward directions.

8. The diaphragm pump according to claim 6, wherein the inflow valve includes an inflow plate extending along a predetermined first direction and disposed against the inflow valve seat; and the inflow-valve presser is a ridge protruding from an upper surface of the second member and pressing opposite end portions of the inflow plate as arranged along the first direction.

9. The diaphragm pump according to claim 8, wherein the inflow valve includes an inflow frame connected to opposite ends of the inflow plate so as to surround the inflow plate;

the first member includes an inflow groove that surrounds a portion of the first member in which the inflow chamber is provided; and the inflow frame fits into the inflow groove.

10. The diaphragm pump according to claim 9, further comprising an inflow sealing rim provided in the upper surface of the second member and pressing the inflow frame against the inflow groove.

11. The diaphragm pump according to claim 6, wherein the outflow valve includes an outflow plate extending along a predetermined first direction and disposed against the outflow valve seat; and the outflow-valve presser is a ridge protruding from a lower surface of the first member and pressing opposite end portions of the outflow plate as arranged along the first direction.

12. The diaphragm pump according to claim 11, wherein the outflow valve includes an outflow frame connected to opposite ends of the outflow plate so as to surround the outflow plate;

the second member includes an outflow groove that surrounds a portion of the second member in which the outflow chamber is provided; and the outflow frame fits into the outflow groove.

13. The diaphragm pump according to claim 12, further comprising an outflow sealing rim provided in the lower surface of the first member and pressing the outflow frame against the outflow groove.

14. An ink supply system comprising:

an ink tank storing ink;

an ink head ejecting the ink onto a recording medium;

an inlet flow channel including one end connected to the ink tank;

an upstream flow channel connected to the ink head and allowing the ink to flow into the ink head;

a connection flow channel connecting the inlet flow channel and the upstream flow channel to each other; and a downstream flow channel including one end connected to the ink head and another end connected to the connection flow channel; wherein the upstream flow channel is provided with an upstream pump and an upstream damper located closer to the ink head than the upstream pump;

the downstream flow channel is provided with a downstream pump and an downstream damper located closer to the ink head than the downstream pump; and each of the upstream pump and the downstream pump is a diaphragm pump according to claim 1.

15. An inkjet printer comprising:

an ink supply system according to claim 14; and a platen on which a recording medium is to be placed.

* * * * *